US010683146B2

(12) United States Patent
Farsai et al.

(10) Patent No.: US 10,683,146 B2
(45) Date of Patent: Jun. 16, 2020

(54) LID ASSEMBLY WITH BUTTON-ACTUATED ROTATING STRAW MECHANISM

(71) Applicant: ENI-JR286, Inc., Torrance, CA (US)

(72) Inventors: Jason Farsai, Long Beach, CA (US); Kyle Pennell, El Segundo, CA (US)

(73) Assignee: ENI-JR286, INC., Torrance, CA (US)

( * ) Notice: Subject to any disclaimer, the term of this patent is extended or adjusted under 35 U.S.C. 154(b) by 89 days.

(21) Appl. No.: 15/839,767

(22) Filed: Dec. 12, 2017

(65) Prior Publication Data

US 2019/0177049 A1 Jun. 13, 2019

(51) Int. Cl.

| | |
|---|---|
| ***B65D 47/06*** | (2006.01) |
| ***A47G 19/22*** | (2006.01) |
| ***B65D 77/28*** | (2006.01) |
| ***B65D 47/20*** | (2006.01) |
| ***A47G 21/18*** | (2006.01) |
| ***B65D 51/24*** | (2006.01) |
| ***A45F 3/16*** | (2006.01) |

(52) U.S. Cl.

CPC ..... *B65D 47/066* (2013.01); *A45F 3/16* (2013.01); *A47G 19/2266* (2013.01); *A47G 19/2272* (2013.01); *A47G 21/185* (2013.01); *B65D 47/2018* (2013.01); *B65D 51/242* (2013.01); *B65D 77/283* (2013.01)

(58) Field of Classification Search

CPC ..... B65D 47/066; B65D 47/2043; B65D 47/2018; B65D 47/065; B65D 47/2006; A47G 21/18; A47G 21/185

USPC ..... 220/708

See application file for complete search history.

(56) References Cited

U.S. PATENT DOCUMENTS

| | | | |
|---|---|---|---|
| 5,150,815 | A | 9/1992 | Saklad |
| D587,069 | S | 2/2009 | Bodum |
| D657,618 | S | 4/2012 | Wahl |
| 8,191,727 | B2 | 6/2012 | Davies et al. |
| D670,134 | S | 11/2012 | Di Lollo |
| D679,996 | S | 4/2013 | Kersten |
| D679,997 | S | 4/2013 | Kersten |
| D682,034 | S | 5/2013 | El-Saden et al. |
| D683,581 | S | 6/2013 | Archer |

(Continued)

OTHER PUBLICATIONS

Restriction Requirement, dated Mar. 8, 2019, received in U.S. Appl. No. 29/635,794.

(Continued)

*Primary Examiner* — Shawn M Braden

(74) *Attorney, Agent, or Firm* — Davis Wright Tremaine LLP; George C. Rondeau, Jr.; Heather M. Colburn

(57) ABSTRACT

A lid assembly that includes at least one curved linkage coupling a button to a spout. The spout has a drinking aperture and is configured to convey a liquid to the drinking aperture. The button is configured to slide linearly between button open and button closed positions. The at least one curved linkage is configured to rotate the spout when the button slides linearly. The at least one curved linkage is configured to rotate the spout into a spout open position when the button is slid linearly into the button open position. The at least one curved linkage is configured to rotate the spout into a spout closed position when the button is slid linearly into the button closed position. The liquid is drinkable by a user from the drinking aperture when the spout is in the spout open position.

35 Claims, 14 Drawing Sheets

(56) References Cited

U.S. PATENT DOCUMENTS

| | | | | |
|---|---|---|---|---|
| D700,014 | S | 2/2014 | Zeanah | |
| D702,079 | S | 4/2014 | Hung | |
| D707,124 | S | 6/2014 | Blain et al. | |
| D724,895 | S | 3/2015 | Kawase et al. | |
| D752,916 | S | 4/2016 | Goodwin et al. | |
| D760,080 | S | 6/2016 | Gorbold | |
| D767,336 | S | 9/2016 | Waggoner et al. | |
| D768,491 | S | 10/2016 | Sorensen et al. | |
| 9,463,911 | B2 | 10/2016 | Choi et al. | |
| D776,483 | S | 1/2017 | Chitayat et al. | |
| D781,104 | S | 3/2017 | Cerasani | |
| D787,886 | S | 5/2017 | Cerasani | |
| D788,529 | S | 6/2017 | Chitayat et al. | |
| 9,770,125 | B2 | 9/2017 | Joy et al. | |
| D812,419 | S | 3/2018 | Yao | |
| D816,411 | S | 5/2018 | Stover | |
| D817,084 | S | 5/2018 | Hammer | |
| D817,094 | S | 5/2018 | Silsby et al. | |
| D828,097 | S | 9/2018 | Silsby | |
| D843,174 | S | 3/2019 | Zhang | |
| 2014/0353275 | A1 | 12/2014 | Hung | |
| 2015/0351568 | A1* | 12/2015 | Blain | A45F 3/18 220/254.5 |
| 2017/0190481 | A1 | 7/2017 | Leimone et al. | |
| 2017/0208974 | A1* | 7/2017 | Zhang | A47G 19/2272 |

OTHER PUBLICATIONS

Non-Final Office Action, dated May 16, 2019, received in U.S. Appl. No. 29/635,794.

* cited by examiner

LID ASSEMBLY WITH BUTTON-ACTUATED ROTATING STRAW MECHANISM

BACKGROUND OF THE INVENTION

Field of the Invention

The present invention is directed generally to lid assemblies for drinking vessels.

Description of the Related Art

Athletes typically prefer to hydrate quickly, which allows them to get back to their workout routines. Unfortunately, many water bottles include lids or caps that thread onto the bottles and require that athletes unscrew the lids or caps before they can drink. This can distract an athlete from the athlete's workout routine.

Some water bottle lids are integrated with a straw. For example, a lid may include a push button that locks and unlocks a spout connected to the straw. The user drinks from the spout and the straw conveys the water from inside the bottle to the spout. The push button may be operated by a spring-loaded mechanism or potential energy stored in a bent tube. Other water bottles may include a lever attached to the spout. The user may pull or push the lever to selectively move the spout into and out of a drinking position.

Unfortunately, prior art water bottle lids have several drawbacks. For example, many water bottle lids require the user to use both hands to fully operate the lid. Additionally, some prior art water bottle lids rely on an overly complicated method of deployment that is distracting to the user and/or erodes the focus that athletes strive for when training, exercising, and competing.

Therefore, a need exists for new lid assembly designs. A lid assembly that includes a spout connected to a straw that can be operated with only one hand is particularly desirable. The present application provides these and other advantages as will be apparent from the following detailed description and accompanying figures.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
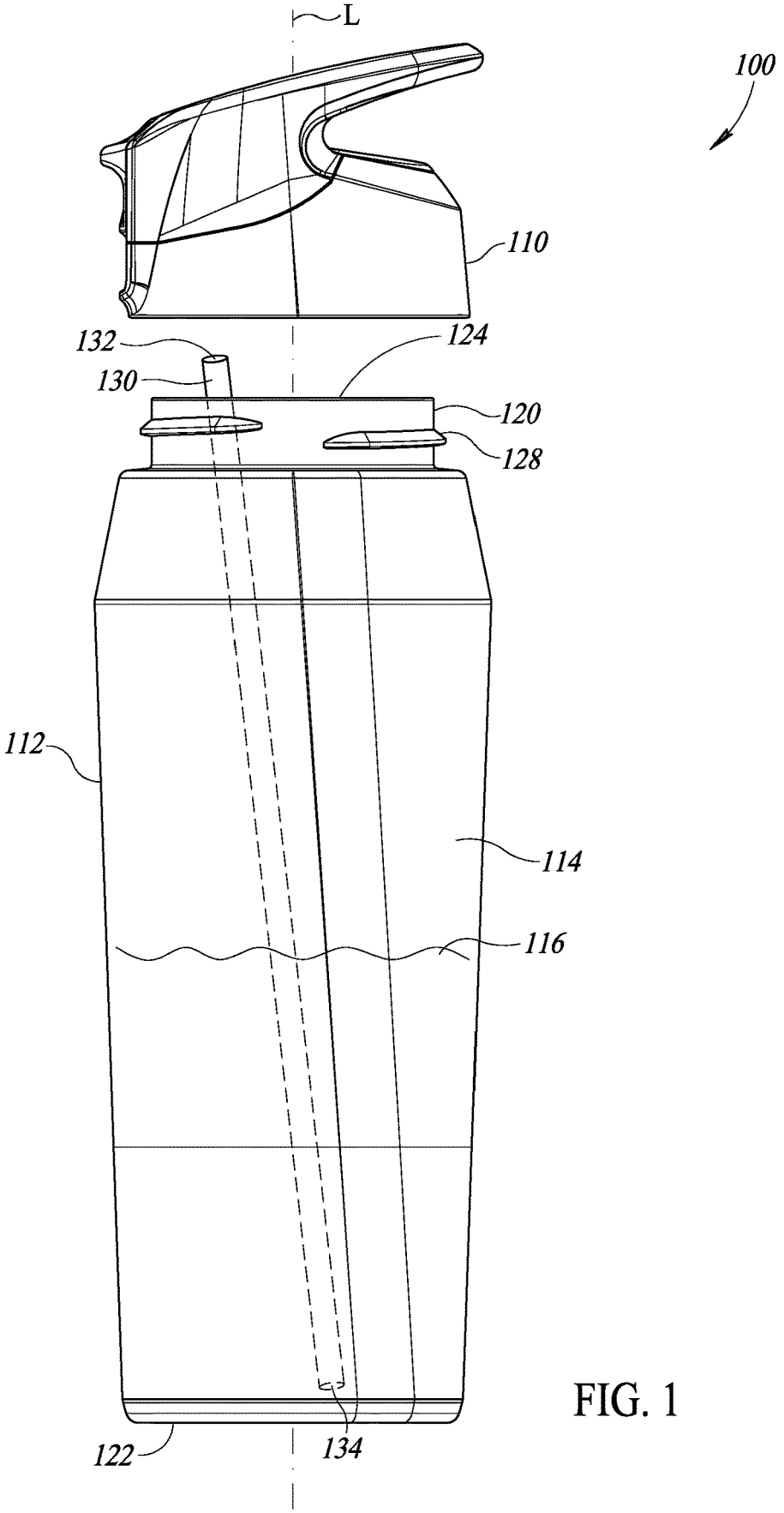
FIG. 1 is a side view of a beverage container with its lid assembly exploded from a vessel containing a straw.
Figure 2:
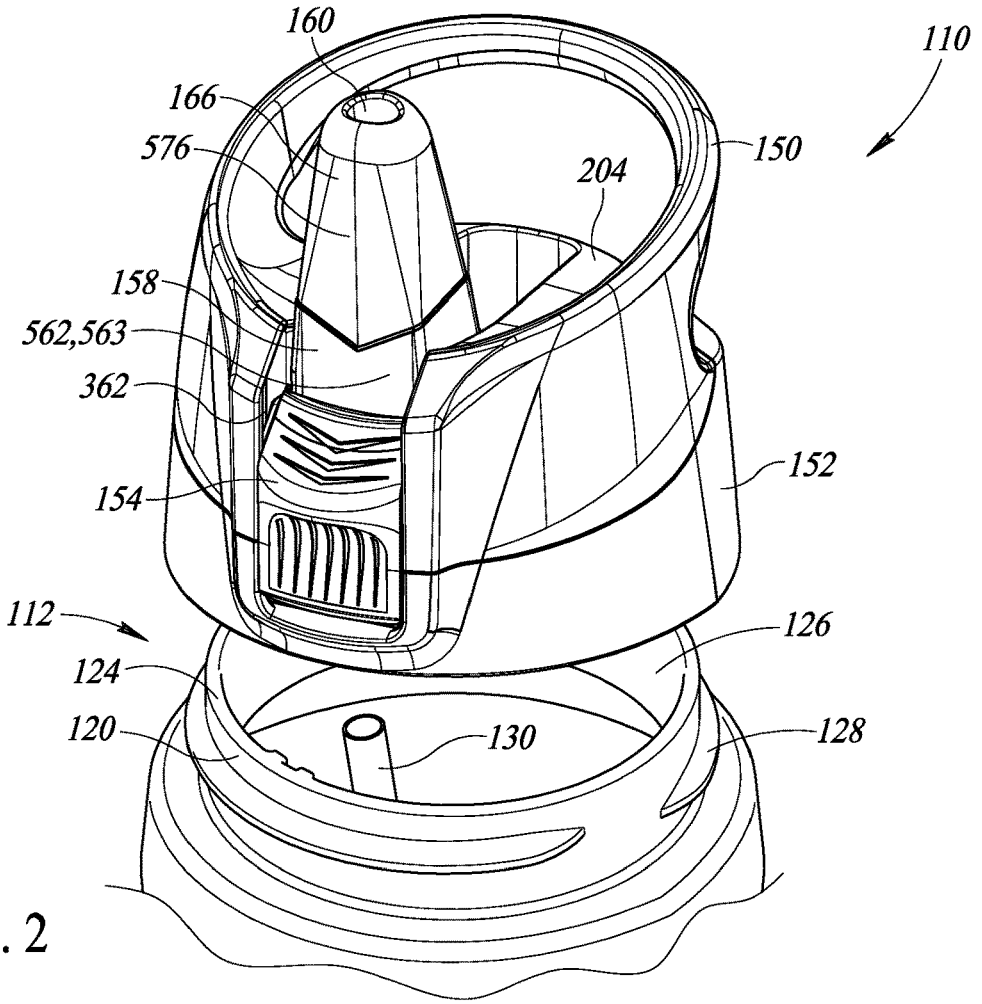
FIG. 2 is an enlarged perspective view of the lid assembly, vessel, and straw of FIG. 1.

FIG. 1 depicts a beverage container 100 (e.g., a water bottle) that extends along a longitudinal axis "L." The beverage container 100 may be used for personal hydration (e.g., to store water) and the like. The beverage container 100 includes a lid assembly 110 removably attachable to a liquid tight generally cup-shaped vessel 112. The vessel 112 defines a fluid tight hollow interior 114 configured to house a beverage or liquid 116 (e.g., water, sports drink, and the like). The vessel 112 has an open upper portion 120 opposite a closed base portion 122. The open upper portion 120 includes an upper edge 124 defining an opening 126 (see FIG. 2) into the hollow interior 114. The liquid 116 may be poured into the hollow interior 114 of the vessel 112 via the opening 126 (see FIG. 2). Referring to FIG. 2, the lid assembly 110 is removably couplable to the open upper portion 120 to close the opening 126. Referring to FIG. 1, in the embodiment illustrated, the open upper portion 120 has outside threads 128 configured to thread into the lid assembly 110 (e.g., by rotating the lid assembly 110 about the longitudinal axis "L" with respect to the vessel 112).

An open-ended tube or straw 130 is inserted into the hollow interior 114 and extends outwardly through the opening 126. The straw 130 is configured to be connected to the lid assembly 110 and to allow the liquid 116 to flow therethrough. The straw 130 is the primary outlet for the liquid 116 from the vessel 112. The straw 130 has a distal open end 132 opposite a proximal open end 134. The distal open end 132 is connected to the lid assembly 110 and the proximal open end 134 is positioned inside the hollow interior 114. In the embodiment illustrated, the proximal open end 134 is positioned at or near the closed base portion 122 of the vessel 112. The straw 130 is in fluid communication with the liquid 116 housed inside the fluid tight hollow interior 114 of the vessel 112.

Figure 4:
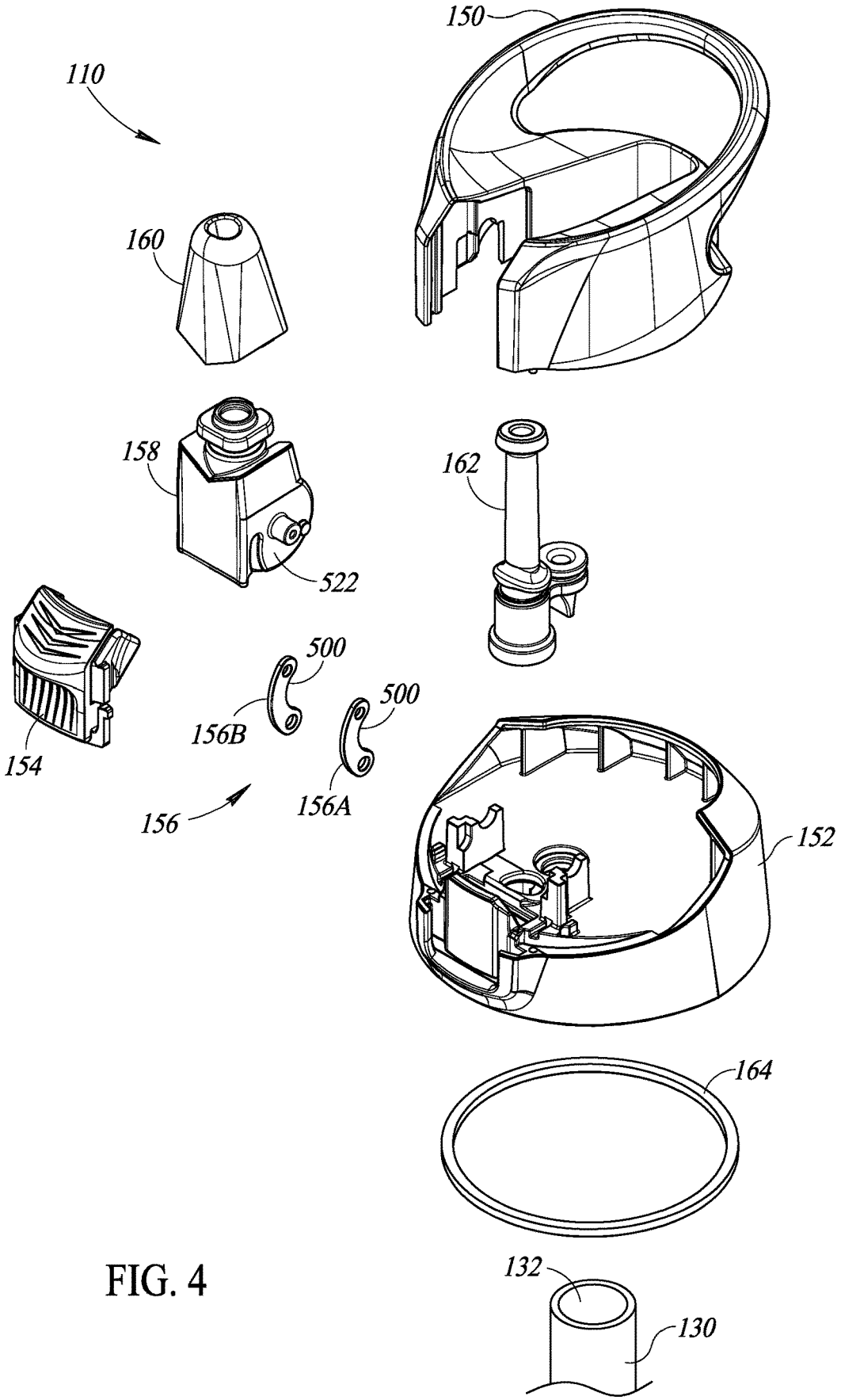
FIG. 4 is an exploded perspective view of the lid assembly and the straw of FIG. 1.
Figure 8:
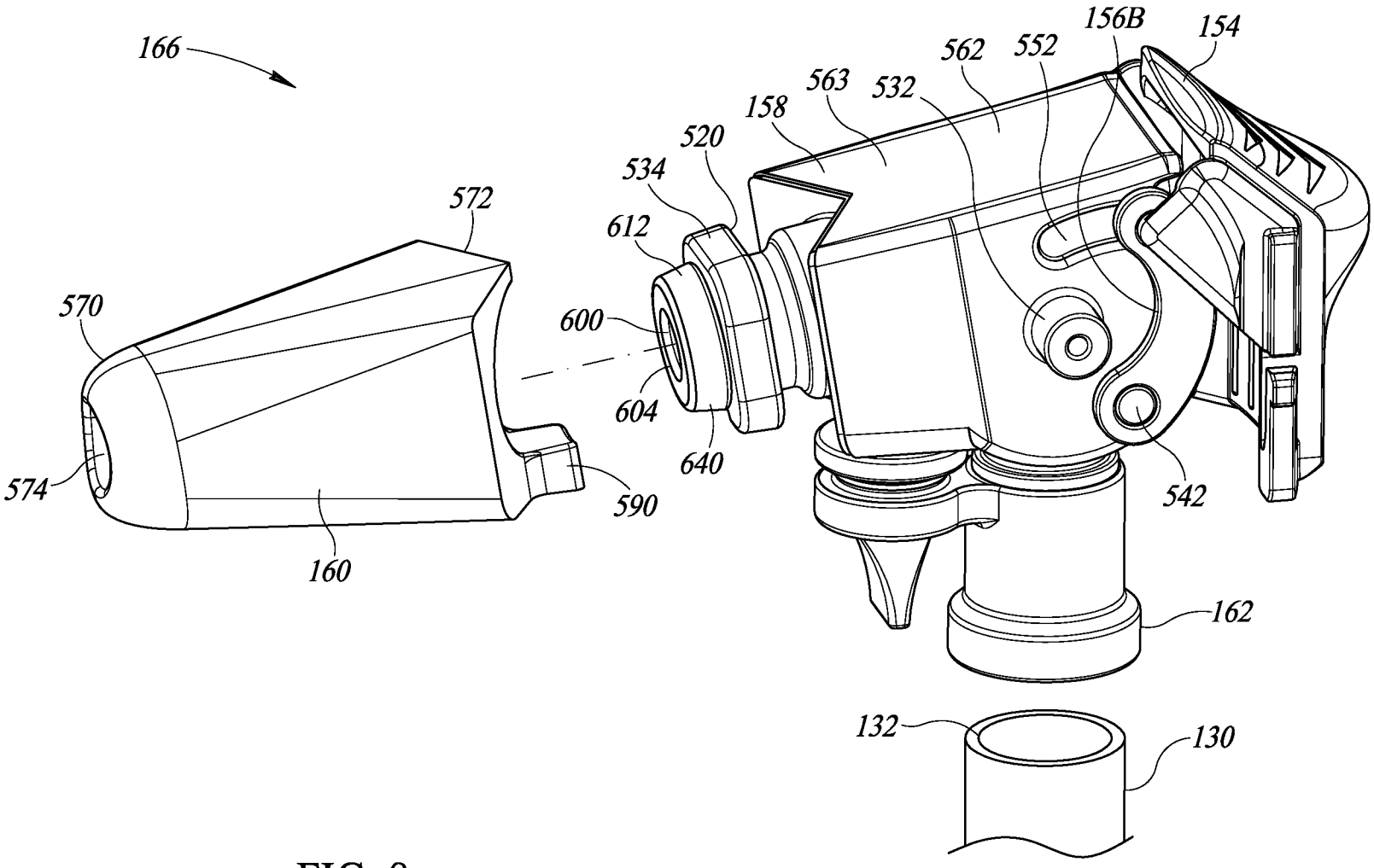
FIG. 8 is a perspective view of a spout tip exploded from the spout of the lid assembly of FIG. 1.

Referring to FIG. 4, the lid assembly 110 includes an upper housing portion 150, a lower housing portion 152, an actuator or button 154, at least one linkage 156, a spout base 158, a spout tip 160, a flexible connector tube 162, and a lid gasket or seal 164. In the embodiment illustrated, the at least one linkage 156 includes first and second linkages 156A and 1566. Referring to FIG. 8, together the spout tip 160, the connector tube 162, and the spout base 158 may be characterized as forming a spout 166. The spout 166 is configured to be coupled to the distal open end 132 of the straw 130.

Figure 5:
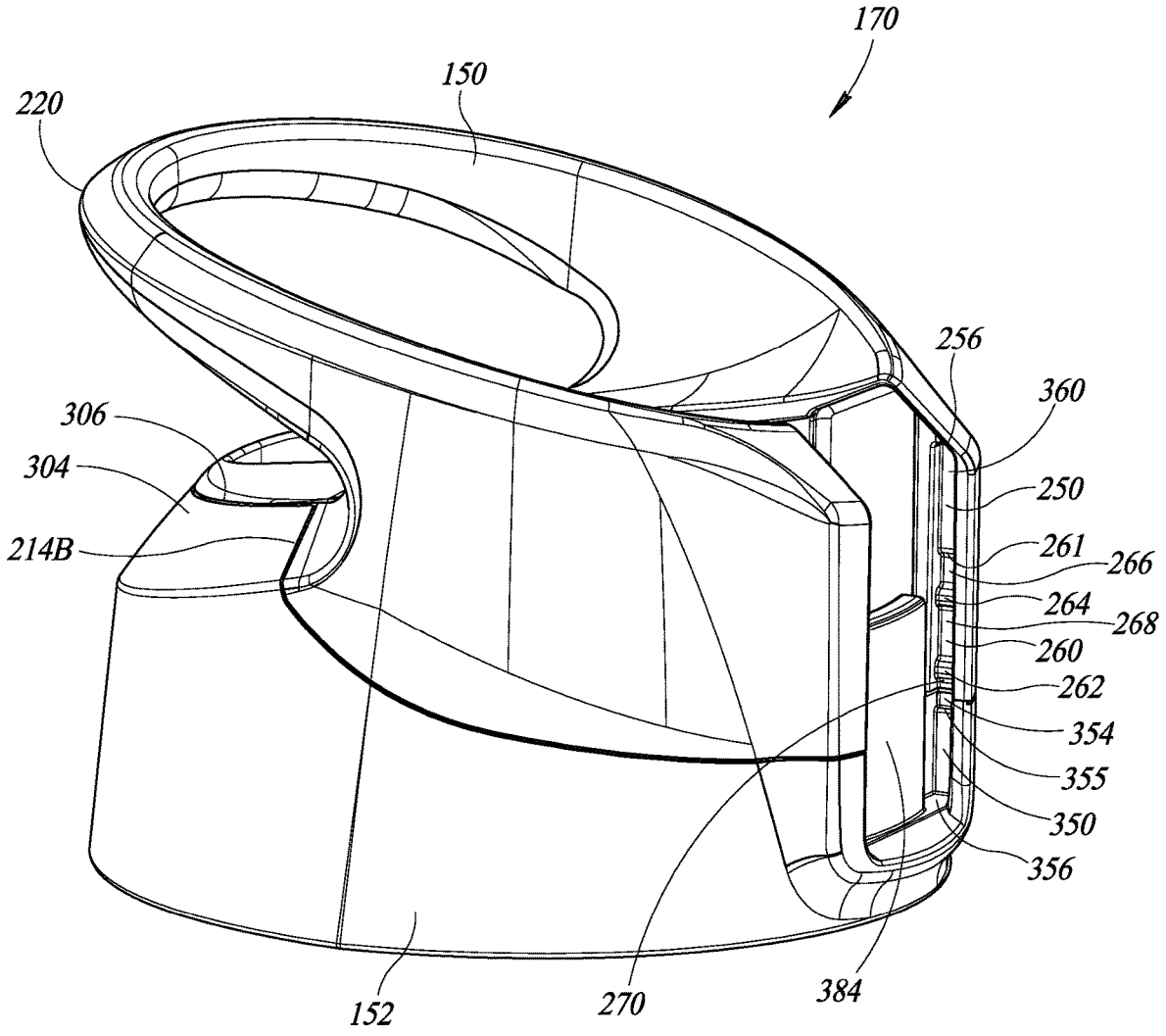
FIG. 5 is a perspective view of a lid housing of the lid assembly of FIG. 1 omitting the sliding button and other components.
Figure 6:
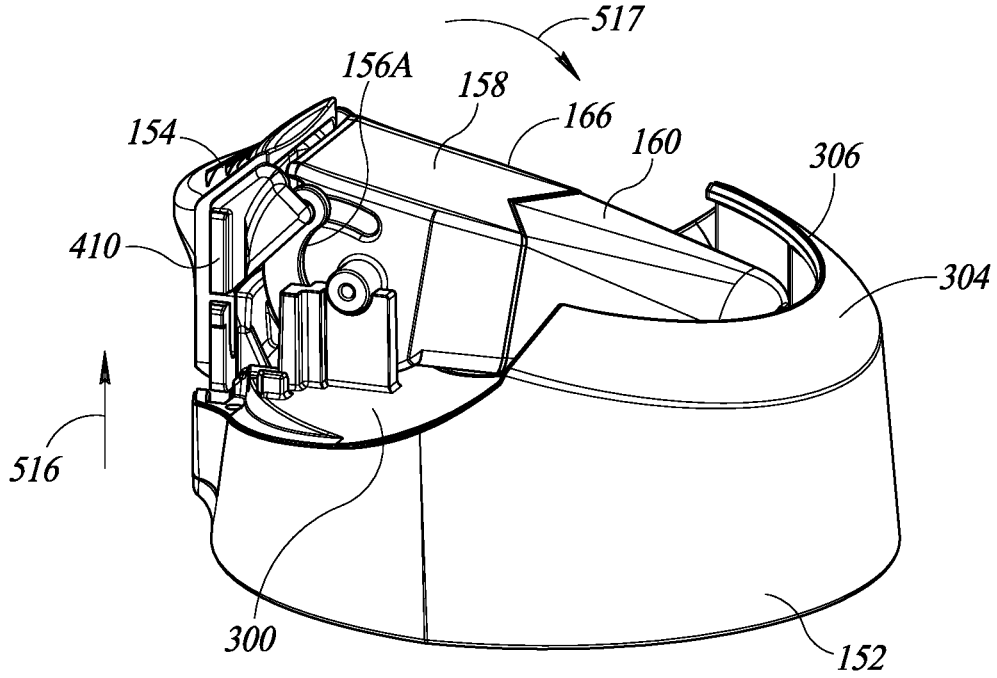
FIG. 6 is a perspective view of the lid assembly of FIG. 1 omitting an upper housing portion and illustrated with its spout in a closed position.
Figure 7:
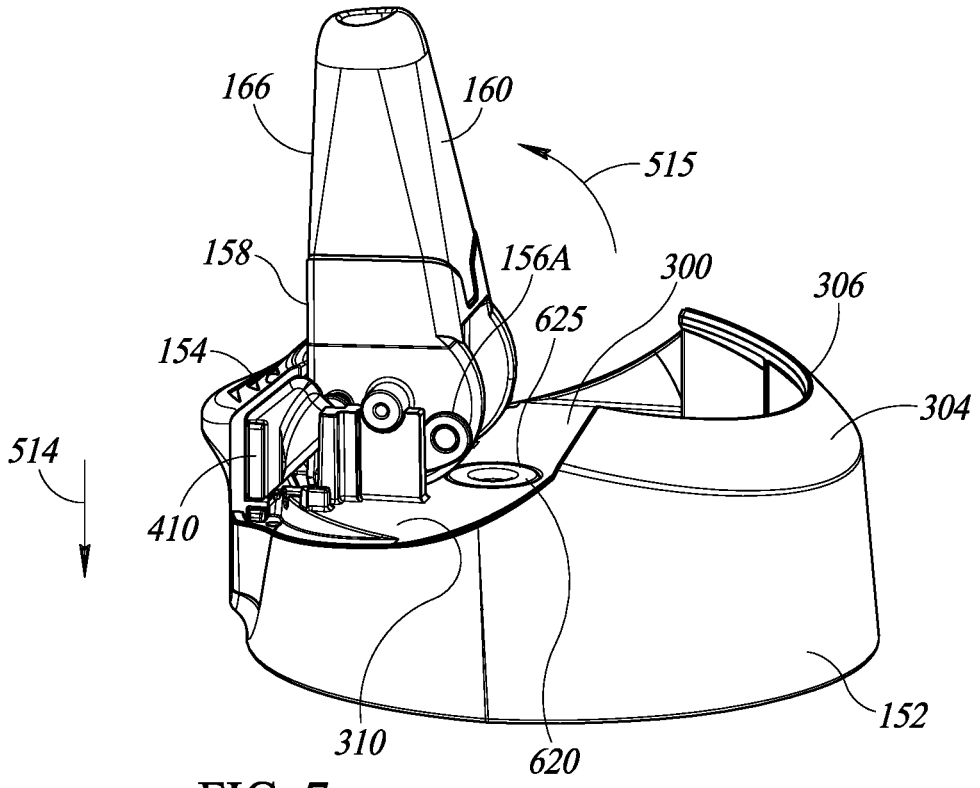
FIG. 7 is a perspective view of the lid assembly of FIG. 1 omitting the upper housing portion and illustrated with its spout in an open position.

Referring to FIG. 5, the upper and lower housing portions 150 and 152 are configured to form a lid housing 170. The upper and lower housing portions 150 and 152 may be ultrasonically welded together using no glue or separate fasteners. Referring to FIGS. 6 and 7, the button 154, the first and second linkages 156A and 1566 (see FIG. 4), the spout base 158, and the spout tip 160 are each configured to move with respect to the lid housing 170 (see FIG. 5). Referring to FIG. 2, the upper and lower housing portions 150 and 152 are designed to hold and capture the button 154 and the rotating spout base 158. The button 154 is positioned along the upper and lower housing portions 150 and 152 and slides along the longitudinal axis "L" (see FIG. 1) with respect to the lid housing 170 (see FIG. 5) between an open position (see FIGS. 2, 3, and 7) and a closed position (see FIGS. 1 and 6). Referring to FIGS. 6 and 7, the connector tube 162 (see FIGS. 3, 4, 8, 20, and 21) is configured to flex as the button 154, the first and second linkages 156A and 156B (see FIG. 4), the spout base 158, and the spout tip 160 each move with respect to the lid housing 170 (see FIG. 5).

The spout tip 160 is coupled to the spout base 158 and moves therewith as a unit. The spout base 158 is selectively rotatable with respect to the lid housing 170 (see FIG. 5) to position the spout 166 in an open position (see FIGS. 2, 3, and 7) or a closed position (see FIGS. 1, 6, and 8). Referring to FIG. 6, as will be described below, the first and second linkages 156A and 1566 (see FIG. 4) couple the button 154 to the spout base 158. When the button 154 is moved from the closed position (see FIGS. 1 and 6) to the open position (see FIGS. 2, 3, and 7), the first and second linkages 156A and 1566 (see FIG. 4) rotate the spout base 158, which rotates the spout 166 from the closed position (see FIGS. 1, 6, and 8) to the open position (see FIGS. 2, 3, and 7). As this occurs, the connector tube 162 flexes from a crimped configuration (see FIGS. 8 and 21) to an un-crimped configuration (see FIGS. 4 and 20). On the other hand, when the button 154 is moved from the open position (see FIGS. 2, 3, and 7) to the closed position (see FIGS. 1 and 6), the first and second linkages 156A and 1566 (see FIG. 4) rotate the spout base 158, which rotates the spout 166 from the open position (see FIGS. 2, 3, and 7) to the closed position (see FIGS. 1, 6, and 8). As this occurs, the connector tube 162 flexes from the un-crimped configuration (see FIGS. 4 and 20) to the crimped configuration (see FIGS. 8 and 21).

Figure 20:
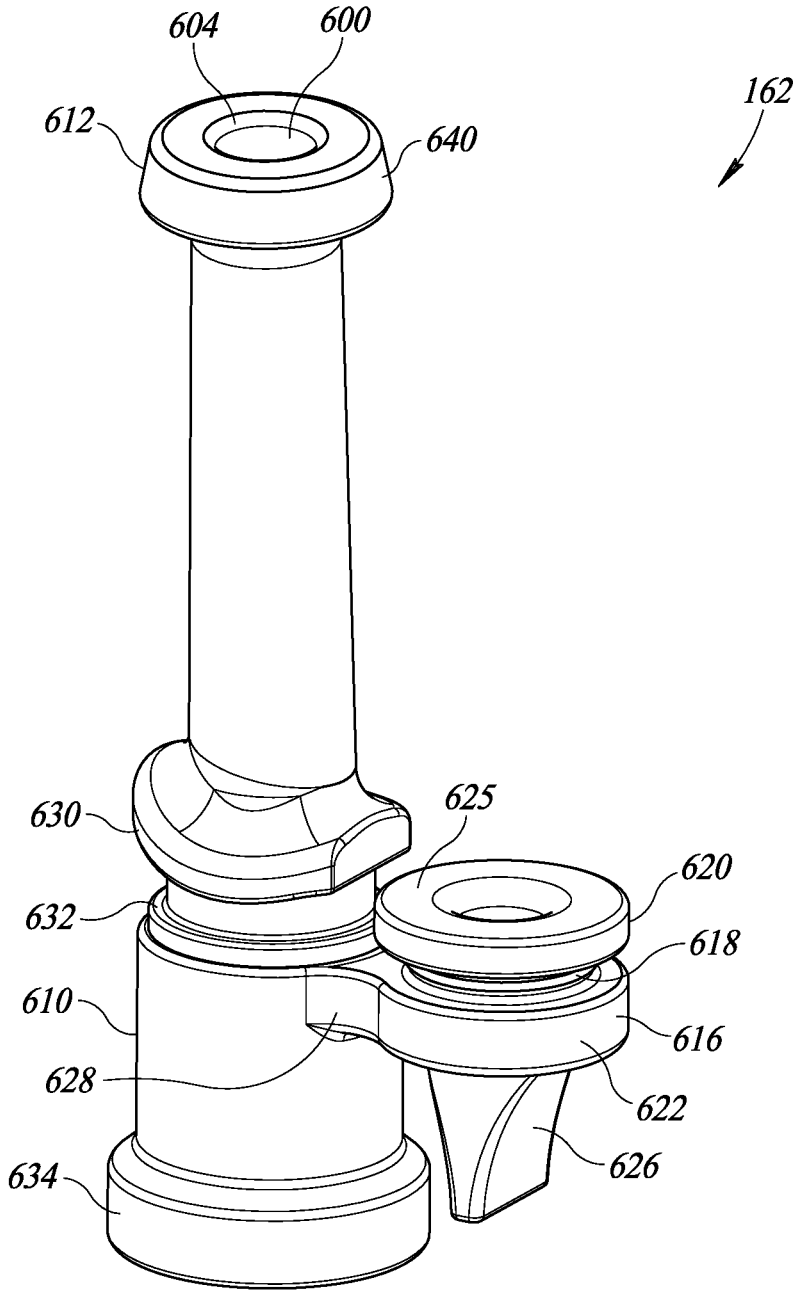
FIG. 20 is a perspective view of a side portion of a connector tube of the lid assembly of FIG. 1 illustrated in an un-crimped configuration.

Referring to FIG. 8, the liquid 116 (see FIG. 1) may flow through the connector tube 162 when the spout 166 is in the open position (see FIGS. 2, 3, and 7) and the connector tube 162 is in the un-crimped configuration (see FIGS. 4 and 20). Referring to FIG. 7, the user may drink from the spout tip 160 when the spout 166 in the open position. Referring to FIG. 8, the liquid 116 (see FIG. 1) is prevented from flowing through the connector tube 162 when the spout 166 in the closed position (see FIGS. 1, 6, and 8) and the connector tube 162 is in the crimped configuration (see FIGS. 8 and 21). Thus, referring to FIG. 6, the liquid 116 (see FIG. 1) is sealed inside the vessel 112 (see FIGS. 1 and 2) when the spout 166 in the closed position.

Upper Housing Portion

Figure 9:
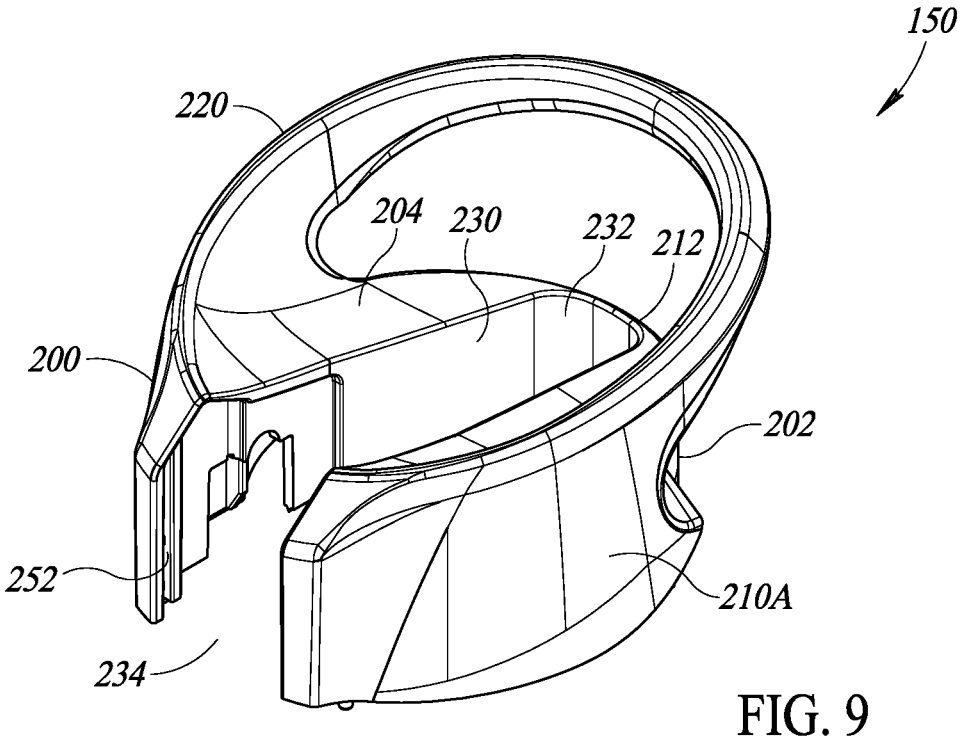
FIG. 9 is a perspective view of a top portion of the upper housing portion of the lid assembly of FIG. 1.
Figure 10:
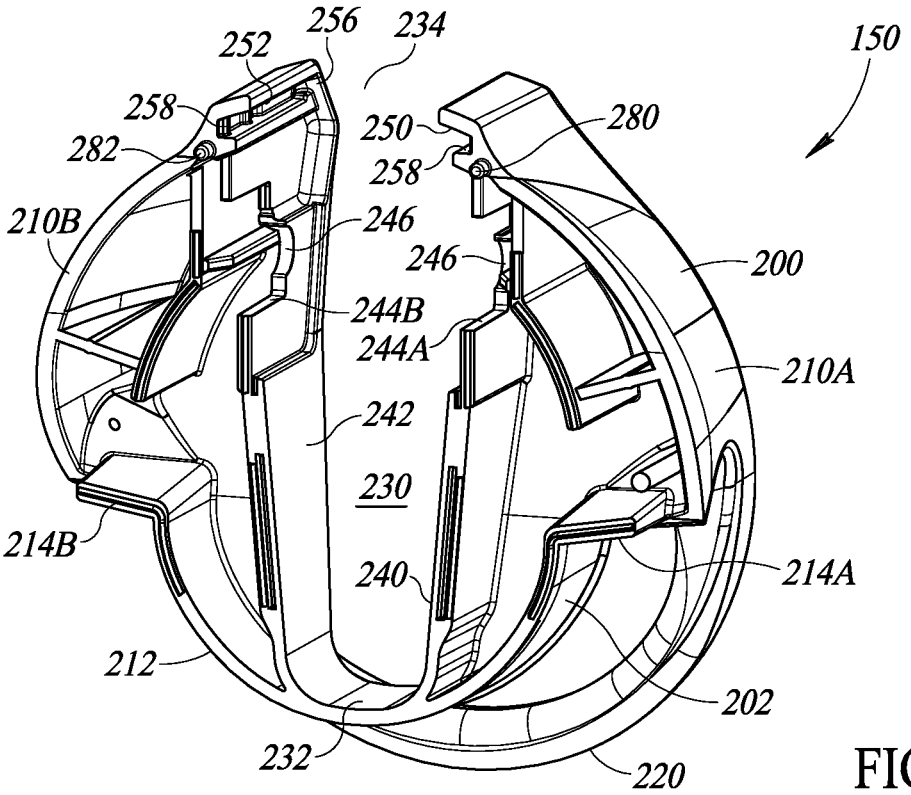
FIG. 10 is a perspective view of a bottom portion of the upper housing portion of the lid assembly of FIG. 1.

Referring to FIG. 9, the upper housing portion 150 has an exposed portion 200 and a covered portion 202 each with a generally semi-circular cross-sectional shape. Referring to FIG. 10, the exposed portion 200 has a larger diameter than the covered portion 202. The exposed portion 200 has an upwardly facing surface 204 surrounded by a discontinuous outer sidewall that includes curved first and second wall portions 210A and 210B. The covered portion 202 has a continuous curved outer sidewall 212. A first connecting wall 214A interconnects the first wall portion 210A with the outer sidewall 212 and a second connecting wall 214B interconnects the second wall portion 210B with the outer sidewall 212.

Optionally, referring to FIG. 9, the upper housing portion 150 may include a handle 220 connected to the exposed portion 200 near the first and second connecting walls 214A and 214B. However, this is not a requirement. In the embodiment illustrated, the handle 220 extends upwardly above the covered portion 202.

A generally U-shaped or V-shaped through-hole 230 extends from the upwardly facing surface 204 into the upper housing portion 150 along the longitudinal axis "L" (see FIG. 1). The through-hole 230 is configured to receive the spout 166 (see FIGS. 2 and 6-8) when the spout 166 is in the closed position (see FIGS. 1, 6, and 8). The through-hole 230 may extend laterally across the upper housing portion 150 between a closed end 232 and an open end 234. The closed end 232 may be formed in a portion of the outer sidewall 212. Referring to FIG. 10, inwardly extending first and second sidewalls 240 and 242 are positioned opposite one another along the through-hole 230. The first and second sidewalls 240 and 242 have first and second cutout portions 244A and 244B, respectively. Each of the first and second cutout portions 244A and 244B includes an upwardly extending semi-circularly shaped recess 246.

Adjacent the open end 234, the first wall portion 210A has a first upper track 250 formed therein that extends along the longitudinal axis "L" (see FIG. 1) and the second wall portion 210B has a second upper track 252 formed therein that extends along the longitudinal axis "L." Each of the first and second upper tracks 250 and 252 includes an upper closed end 256 formed opposite a lower open end 258. Referring to FIG. 5, each of the first and second upper tracks 250 and 252 (see FIG. 10) includes a recessed portion 260 that extends from the lower open end 258 (see FIG. 10) partway toward the upper closed end 256. In the embodiment illustrated, the recessed portion 260 includes an end wall 261 positioned between the upper closed end 256 and the lower open end 258 (see FIG. 10). A first projection or stop 262 is positioned in the recessed portion 260 and is spaced upwardly from the lower open end 258 (see FIG. 10). A second projection or stop 264 is positioned in the recessed portion 260 between the end wall 261 and the first stop 262. A first recessed portion 266 is defined between the end wall 261 and the second stop 264 and a second recessed portion 268 is defined between the second stop 264 and the first stop 262. A third recessed portion 270 is positioned below the first stop 262. As will be described below, the third recessed portions 270 extend downwardly beyond the first and second upper tracks 250 and 252.

Referring to FIG. 10, adjacent the first and second upper tracks 250 and 252, the upper housing portion 150 includes downwardly extending projections 280 and 282, respectively.

Lower Housing Portion

Figure 11:
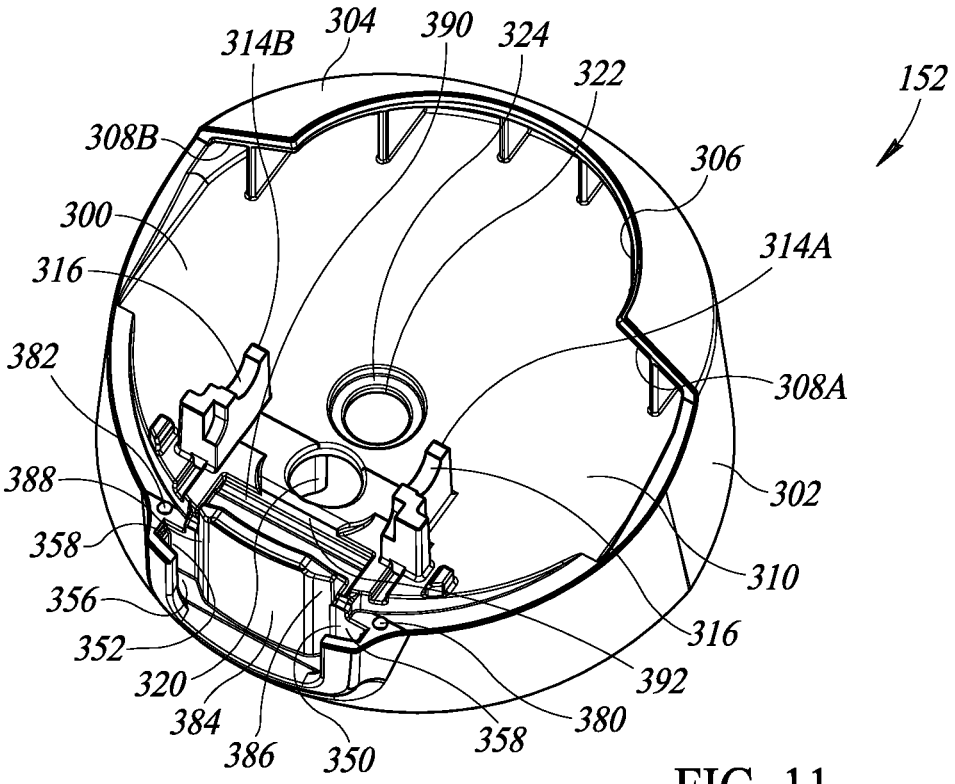
FIG. 11 is a perspective view of a top portion of a lower housing portion of the lid assembly of FIG. 1.

Referring to FIG. 11, the lower housing portion 152 has a generally circular cross-sectional shape. The lower housing portion 152 includes a platform 300 surrounded by a downwardly extending sidewall 302. In the embodiment illustrated, a cover portion 304 extends upwardly from the platform 300 along a portion of a periphery of the platform 300. The cover portion 304 is configured to cover the covered portion 202 (see FIGS. 9 and 10) of the upper housing portion 150 (see FIGS. 2-5, 9, and 10). The cover portion 304 has a curved edge 306 configured to abut the outer sidewall 212 (see FIGS. 9 and 10) of the upper housing portion 150 (see FIGS. 2-5, 9, and 10). The cover portion 304 has first and second edges 308A and 308B configured to abut the connecting walls 214A and 214B (see FIG. 10), respectively, of the upper housing portion 150 (see FIGS. 2-5, 9, and 10).

Figure 12:
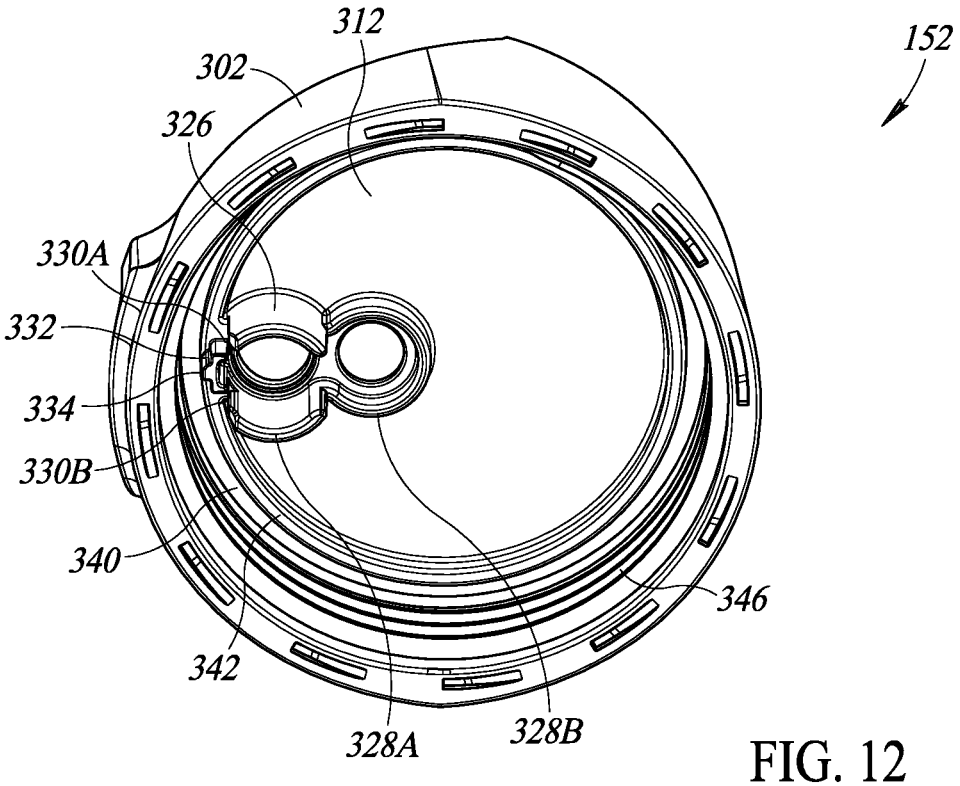
FIG. 12 is a perspective view of a bottom portion of the lower housing portion of the lid assembly of FIG. 1.

The platform 300 has an upwardly facing surface 310 opposite a downwardly facing surface 312 (see FIG. 12). Spaced apart first and second support walls 314A and 314B extend upwardly from the upwardly facing surface 310. The first and second support walls 314A and 314B are configured to be received inside the first and second cutout portions 244A and 244B (see FIG. 10), respectively. Each of the first and second support walls 314A and 3146 includes a downwardly extending semi-circularly shaped recess 316. When the first and second support walls 314A and 3146 are received inside the first and second cutout portions 244A and 244B (see FIG. 10), respectively, the recesses 246 (see FIG. 10) are aligned with the recesses 316.

The platform 300 has first and second through-holes 320 and 322. The first through-hole 320 is positioned in between the first and second support walls 314A and 314B. The second through-hole 322 is positioned more centrally than the first through-hole 320. An annular recess 324 may be formed in the upwardly facing surface 310 and surround the second through-hole 322.

Referring to FIG. 12, a sidewall 326 extends downwardly from the downwardly facing surface 312 and surrounds the first and second through-holes 320 and 322 (see FIG. 11). In the embodiment illustrated, a first wall portion 328A of the sidewall 326 surrounds at least a portion of the first through-hole 320 (see FIG. 11) and extends downwardly further than a second wall portion 328B of the sidewall 326 that surrounds at least a portion of the second through-hole 322 (see FIG. 11). The first wall portion 328A includes cutout portions 330A and 330B that flank a portion 332. In the embodiment illustrated, the portion 332 includes an outwardly projecting portion 334.

Figure 3:
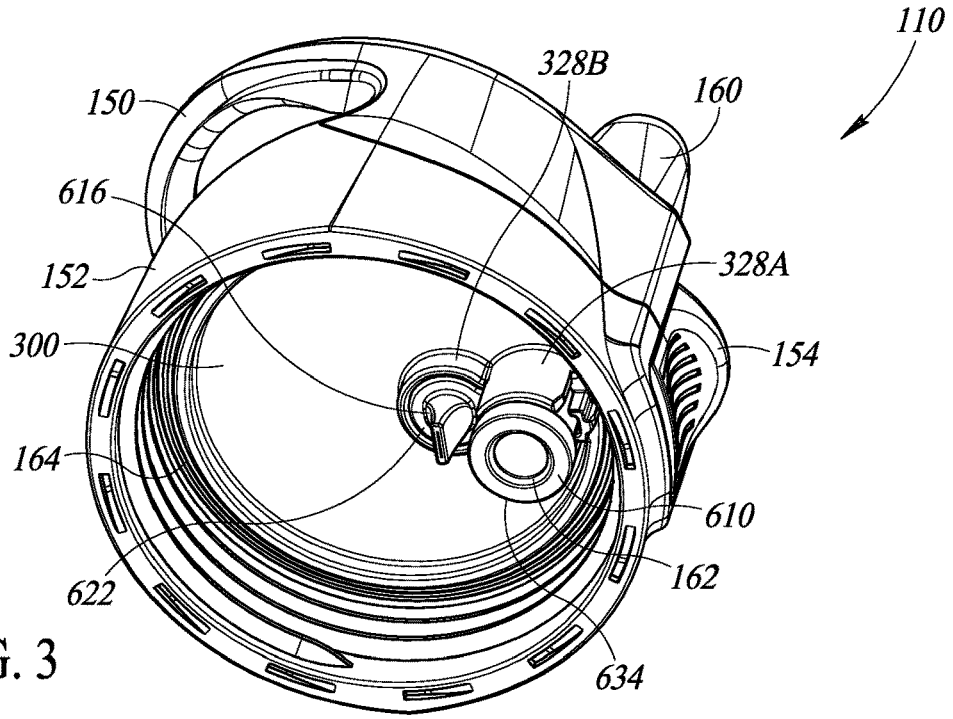
FIG. 3 is a perspective view of an underside of the lid assembly of FIG. 1.

The downwardly facing surface 312 includes a groove 340 configured to receive the lid seal 164 (see FIGS. 3 and 4). The groove 340 is formed between the sidewall 302 and an annular inner stop wall 342. The sidewall 302 may include inside threads 346 configured to mate with the outside threads 128 (see FIGS. 1 and 2) of the vessel 112 (see FIGS. 1 and 2).

Referring to FIG. 11, the sidewall 302 includes a first lower track 350 spaced apart from a second lower track 352. The first and second lower tracks 350 and 352 each have a lower closed end 356 opposite an upper open end 358. Referring to FIG. 5, the first and second lower tracks 350 and 352 (see FIG. 11) each include a recessed portion 354 that extends downwardly from the upper open end 358 (see FIG. 11) partway toward the lower closed end 356. Thus, the recessed portion 354 has an end portion 355 positioned between the upper open end 358 (see FIG. 11) and the lower closed end 356. As can be seen in FIG. 5, the third recessed portion 270 is defined between the end portion 355 and the first stop 262 of the upper housing portion 150. Thus, an upper portion of the third recessed portion 270 is defined by the upper housing portion 150 and a lower portion of the third recessed portion 270 is defined by the lower housing portion 152.

Referring to FIG. 11, the upper open ends 358 of the first and second lower tracks 350 and 352 are positioned to align with the lower open ends 258 (see FIG. 10) of the first and second upper tracks 250 and 252 (see FIG. 10), respectively, of the upper housing portion 150 (see FIGS. 2-5, 9, and 10). Referring to FIG. 5, together the first upper and lower tracks 250 and 350 define a first closed track 360. Similarly, referring to FIG. 10, together the second upper and lower tracks 252 and 352 (see FIG. 11) define a second closed track 362 (see FIG. 2). Referring to FIG. 2, as will be described below, the button 154 is configured to be mounted in the first and second closed tracks 360 (see FIG. 5) and 362 and to slide therein. In the embodiment illustrated, the first and second closed tracks 360 (see FIG. 5) and 362 extend along the longitudinal axis "L" (see FIG. 1).

Referring to FIG. 11, the sidewall 302 may include recesses 380 and 382 configured to receive the projections 280 and 282 (see FIG. 10), respectively. A portion 384 of the sidewall 302 may extend between the first and second lower tracks 350 and 352. A first recess 386 may be formed in the portion 384 alongside the first lower track 350 and a second recess 388 may be formed in the portion 384 alongside the second lower track 352.

The upwardly facing surface 310 of the platform 300 may include a recess 390 that positioned in between the first through-hole 320 and the portion 384 of the sidewall 302. The recess 390 is spaced apart from and extends alongside the portion 384 of the sidewall 302. In the embodiment illustrated, the recess 390 has a substantially linear shape. A stop wall 392 is positioned in between the recess 390 and the first through-hole 320. In the embodiment illustrated, the stop wall 392 has a tapered side that tapers downwardly toward the first through-hole 320.

Button

Figure 13:
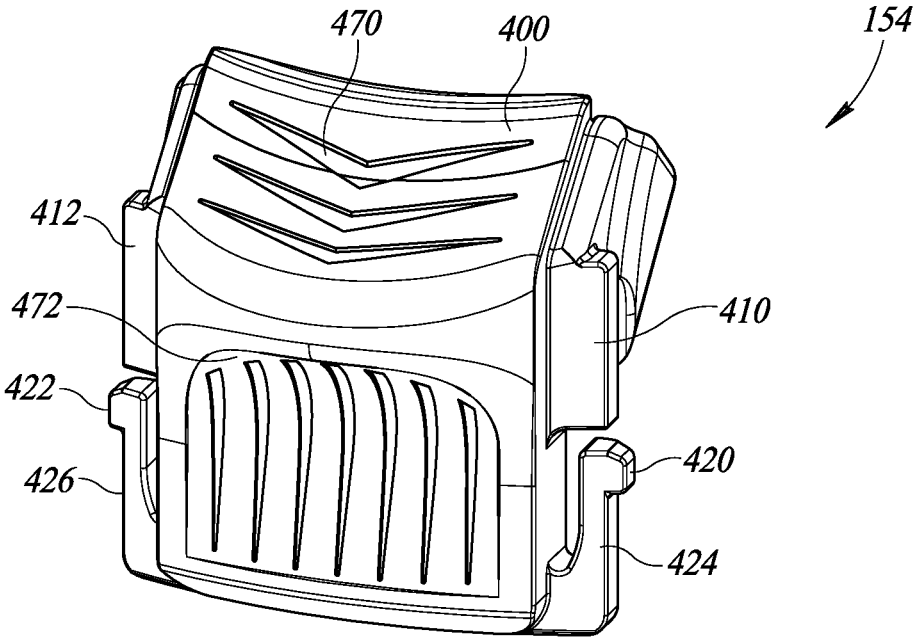
FIG. 13 is a perspective view of a front portion of a sliding button of the lid assembly of FIG. 1.
Figure 14:
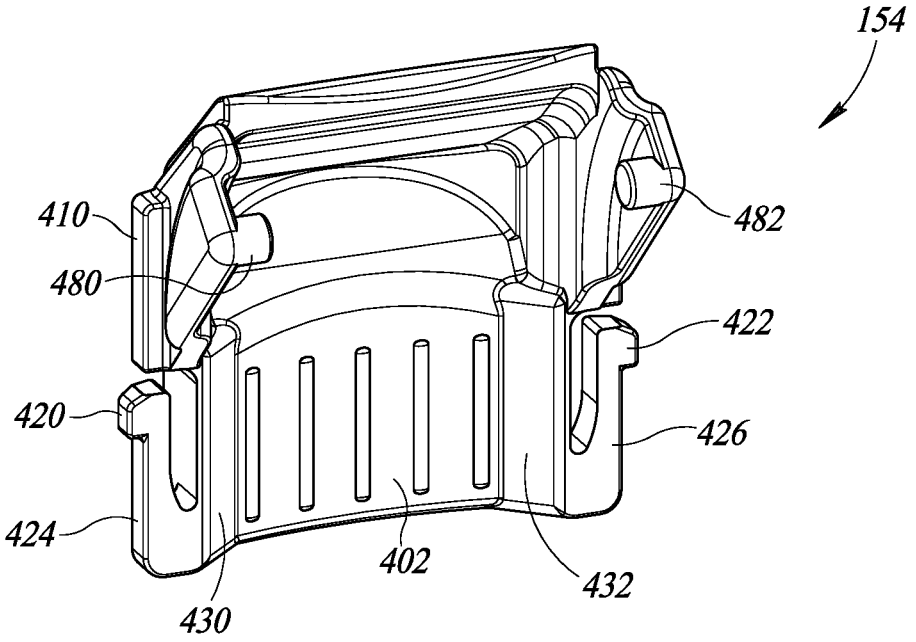
FIG. 14 is a perspective view of a back portion of the sliding button of the lid assembly of FIG. 1.

Referring to FIG. 13, the button 154 has an outwardly facing side 400 opposite an inwardly facing side 402 (see FIG. 14). Referring to FIG. 2, as mentioned above, the button 154 is configured to slide within the first and second closed tracks 360 (see FIG. 5) and 362 along the longitudinal axis "L" (see FIG. 1). Thus, the button 154 is positioned to slide between of the upper and lower housing portions 150 and 152 as opposed to being positioned on the top of the lid assembly 110.

Referring to FIG. 13, the button 154 has first and second side rails 410 and 412 configured to slide within the first and second closed tracks 360 (see FIG. 5) and 362 (see FIG. 2), respectively. The button 154 also has outwardly extending tabs 420 and 422 configured to be positioned inside the first and second closed tracks 360 (see FIG. 5) and 362 (see FIG. 2), respectively. The first and second closed tracks 360 (see FIG. 5) and 362 (see FIG. 2) constrain the motion of the button 154 and limit the button 154 to moving linearly (e.g., along the longitudinal axis "L" illustrated in FIG. 1) with respect to the lid housing 170 (see FIG. 5). In the embodiment illustrated, the first and second side rails 410 and 412 are aligned with the tabs 420 and 422, respectively, along the longitudinal axis "L" (see FIG. 1).

The tabs 420 and 422 are mounted on arms 424 and 426, respectively, configured to flex inwardly and allow the tabs 420 and 422 to traverse the first and second stops 262 and 264 (see FIG. 5) in the first and second closed tracks 360 (see FIG. 5) and 362 (see FIG. 2), respectively. Referring to FIG. 14, the button 154 has projecting portions 430 and 432 adjacent the arms 424 and 426, respectively. The projecting portions 430 and 432 are configured to be positioned in the first and second recesses 386 and 388, respectively, and to slide therein. The arms 424 and 426 are connected to the projecting portions 430 and 432, respectively, and extend outwardly therefrom.

Referring to FIG. 5, when the button 154 (see FIGS. 2-4, 6-8, 13, and 14) is in the closed position (see FIGS. 1 and 6), the tabs 420 and 422 (see FIGS. 13 and 14) are positioned in the first recessed portions 266 of the first and second closed tracks 360 (see FIG. 5) and 362 (see FIG. 2), respectively. On the other hand, when the button 154 (see FIGS. 2-4, 6-8, 13, and 14) is in the open position (see FIGS. 2, 3, and 7), the tabs 420 and 422 (see FIGS. 13 and 14) are positioned in the third recessed portions 270 of the first and second closed tracks 360 (see FIG. 5) and 362 (see FIG. 2), respectively.

Referring to FIG. 13, the outwardly facing side 400 has first and second angled or curved surfaces 470 and 472. The first curved surface 470 is positioned to be pressed upon by a user when the user wishes to push the button 154 downwardly into the open position (see FIGS. 2, 3, and 7). The second curved surface 472 is positioned to be pressed upon by a user when the user wishes to push the button 154 upwardly into the closed position (see FIGS. 1 and 6). Both of the first and second curved surfaces 470 and 472 are configured to be pressed upon by a single finger (e.g., the thumb) and therefore facilitate one-handed operation of the lid assembly 110 (see FIGS. 1-4) of the beverage container 100 (see FIG. 1).

Referring to FIG. 14, the button 154 includes first and second pivot pins 480 and 482. The first and second pivot pins 480 and 482 are aligned with and extend toward one another.

Linkages

Referring to FIG. 4, the first and second linkages 156A and 156B are substantially identical to one another. Therefore, only the first linkage 156A will be described in detail.

Figure 15:
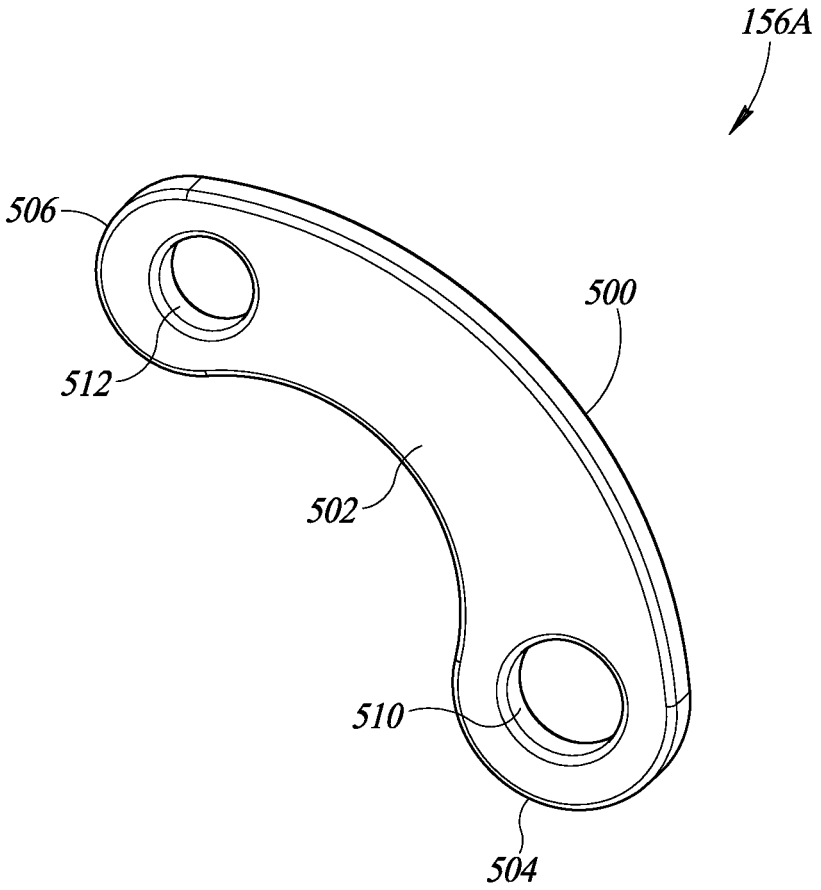
FIG. 15 is a perspective view of a side portion of a linkage of the lid assembly of FIG. 1.

Referring to FIG. 15, the first linkage 156A may have substantially planar first and second sides 500 and 502. The first linkage 156A has a first end portion 504 opposite a second end portion 506. The first linkage 156A is curved between the first and second end portions 504 and 506. In the embodiment illustrated, the first end portion 504 is larger than the second end portion 506.

A first through-hole 510 is formed in the first end portion 504 and a second through-hole 512 is formed in the second end portion 506. The first end portion 504 is connected to the spout base 158 (see FIGS. 2, 4, and 6-8) and is rotatable with respect to the spout base 158. The second through-hole 512 of the first linkage 156A is configured to receive the first pivot pin 480 (see FIG. 14) of the button 154 (see FIGS. 2-4, 6-8, 13, and 14), which is inserted into the second through-hole 512 from the first side 500. The first linkage 156A is rotatable about the first pivot pin 480. Similarly, the second through-hole 512 of the second linkage 156B (see FIGS. 4 and 8) is configured to receive the second pivot pin 482 (see FIG. 14) of the button 154 (see FIGS. 2-4, 6-8, 13, and 14), which is inserted into the second through-hole 512 from the second side 502. Thus, the second linkage 156B (see FIGS. 4 and 8) is rotatable about the second pivot pin 482 (see FIG. 14).

Referring to FIG. 7, when the user pushes the button 154 downwardly (e.g., in a direction identified by an arrow 514) into the open position, the second through-hole 512 (see FIG. 15) of the first linkage 156A rotates about the first pivot pin 480 (see FIG. 14) of the button 154. At the same time, the first pivot pin 480 (see FIG. 14) pushes the second end portion 506 (see FIG. 15) of the first linkage 156A downwardly. Similarly, the second through-hole 512 (see FIG. 15) of the second linkage 1566 (see FIGS. 4 and 8) rotates about the second pivot pin 482 (see FIG. 14) of the button 154. At the same time, the second pivot pin 482 (see FIG. 14) pushes the second end portion 506 (see FIG. 15) of the second linkage 156B (see FIGS. 4 and 8) downwardly. As the first and second linkages 156A and 156B (see FIG. 4) are pushed downwardly, the first end portion 504 (see FIG. 15) rotates the spout base 158 away from the platform 300 (e.g., in a direction identified by a curved arrow 515), which causes the spout 166 to transition from the closed position (see FIGS. 1, 6, and 8) to the open position (see FIGS. 2, 3, and 7).

Referring to FIG. 6, when the user pushes the button 154 upwardly (e.g., in a direction identified by an arrow 516) into the closed position, the second through-hole 512 (see FIG. 15) of the first linkage 156A rotates about the first pivot pin 480 (see FIG. 14) of the button 154. At the same time, the first pivot pin 480 (see FIG. 14) pulls the second end portion 506 (see FIG. 15) of the first linkage 156A upwardly. Similarly, the second through-hole 512 (see FIG. 15) of the second linkage 156B (see FIGS. 4 and 8) rotates about the second pivot pin 482 (see FIG. 14) of the button 154. At the same time, the second pivot pin 482 (see FIG. 14) pulls the second end portion 506 (see FIG. 15) of the second linkage 156B (see FIGS. 4 and 8) upwardly. As the first and second linkages 156A and 156B (see FIG. 4) are pulled upwardly, the first end portions 504 (see FIG. 15) of the first and second linkages 156A and 156B rotate the spout base 158 toward the platform 300 (e.g., in a direction identified by a curved arrow 517), which causes the spout 166 to transition from the open position (see FIGS. 2, 3, and 7) to the closed position (see FIGS. 1, 6, and 8).

Referring to FIGS. 6 and 7, the curvature of the first and second linkages 156A and 156B (see FIG. 4) allows the spout base 158 to be rotated by over 100 degrees (e.g., in the directions identified by the curved arrows 515 and 517) with respect to the lid housing 170 (see FIG. 5). The first and second linkages 156A and 156B (see FIG. 4) provide a mechanical advantage. A ratio of a rotation angle (e.g., in degrees) over which the spout base 158 rotates with respect to the lid housing 170 (see FIG. 5) to a travel distance (e.g., in millimeters) over which the button 154 travels (e.g., in the directions identified by the arrows 514 and 516) is made possible by the first and second linkages 156A and 156B (see FIG. 4). By way of non-limiting examples, the rotation distance may be about 110 degrees, and the travel distance may be about 10 millimeters. Thus, the ratio may be about 11 degrees of spout rotation per one millimeter of linear distance of button translation.

Spout Base

Figure 16:
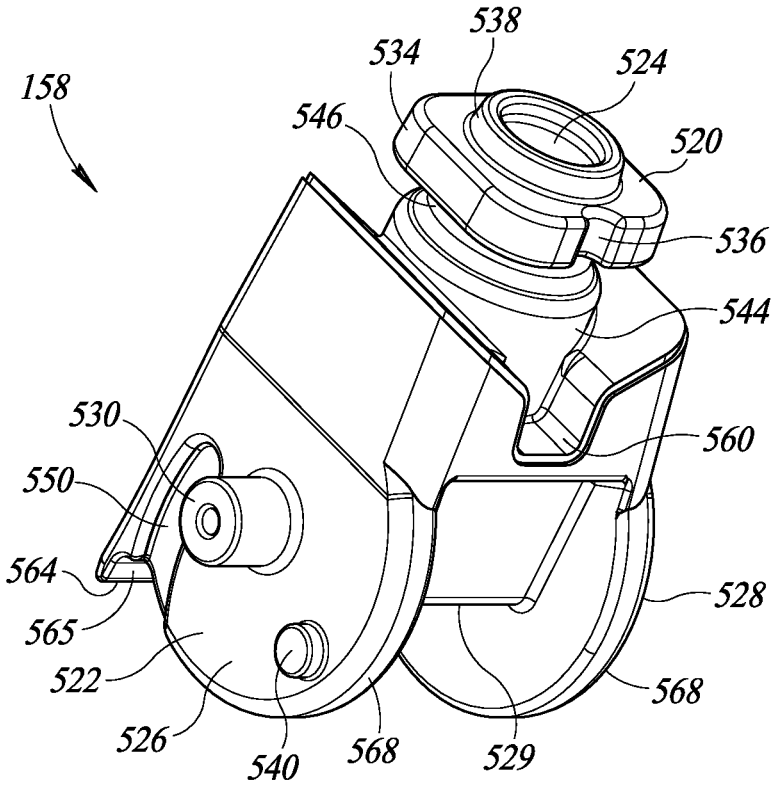
FIG. 16 is a perspective view of a side portion of a spout base of the lid assembly of FIG. 1.

Referring to FIG. 16, the spout base 158 includes a free end portion 520 opposite a tethered portion 522. Referring to FIG. 8, the free end portion 520 is configured to be coupled to the spout tip 160 to form part of the spout 166 (see FIGS. 2 and 6-8). Referring to FIG. 16, the free end portion 520 includes a locking portion 534 with a notch 536 formed therein. A distal portion 538 of the free end portion 520 extends outwardly beyond the locking portion 534. A proximal portion 544 of the free end portion 520 extends inwardly toward the tethered portion 522. In the embodiment illustrated, the distal and proximal portions 538 and 544 are each generally cylindrically shaped. An annular recess 546 is formed along the outside of the proximal portion 544 below the locking portion 534. In the embodiment illustrated, the locking portion 534 has a generally square or rectangular outer shape.

Referring to FIG. 4, the tethered portion 522 is configured to be trapped between the upper and lower housing portions 150 and 152. The first and second linkages 156A and 156B connect the tethered portion 522 to the button 154. Thus, when the button 154 moves, the tethered portion 522 moves therewith.

Referring to FIG. 16, the spout base 158 includes an open-ended channel 524 that extends through both the free end portion 520 and the tethered portion 522. The open-ended channel 524 is configured to receive the connector tube 162 (see FIGS. 3, 4, 8, 20, and 21), which lines the open-ended channel 524.

The spout base 158 has a first side portion 526 opposite a second side portion 528. A sidewall 529 extends between the first and second side portions 526 and 528. Referring to FIG. 8, the sidewall 529 (see FIGS. 16 and 17) is configured to crimp the connector tube 162 when the spout 166 is in the closed position (see FIGS. 1, 6, and 8).

Figure 17:
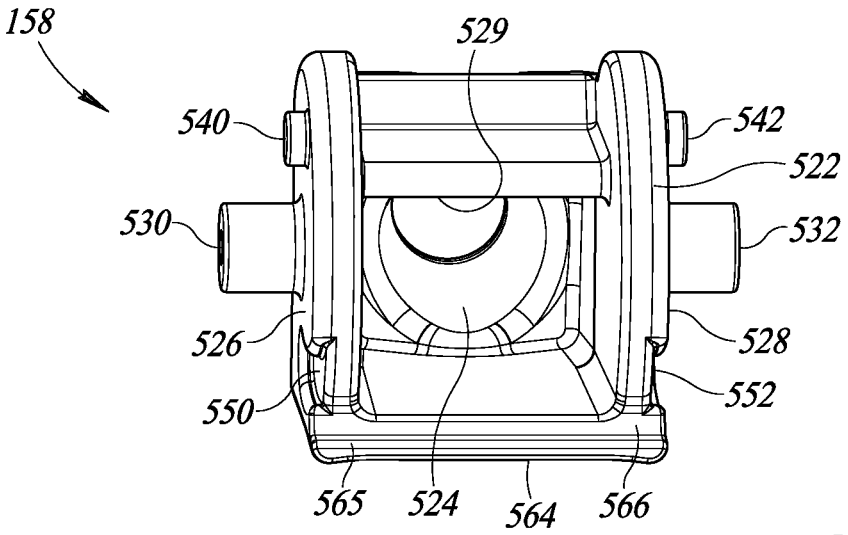
FIG. 17 is a perspective view of an underside of the spout base of the lid assembly of FIG. 1.

Referring to FIG. 17, the tethered portion 522 of the spout base 158 includes first and second pivot pins 530 and 532 that extend outwardly from the first and second side portions 526 and 528, respectively. The first pivot pin 530 is configured to be positioned inside the semi-circularly shaped recess 246 (see FIG. 10) of the first cutout portion 244A (see FIG. 10) and the semi-circularly shaped recess 316 (see FIG. 11) of the first support wall 314A (see FIG. 11) when the first support wall 314A is received inside the first cutout portion 244A. The first pivot pin 530 is also configured to rotate inside the aligned recesses 246 (see FIG. 10) and 316 (see FIG. 11) with respect to the lid housing 170 (see FIG. 5). The second pivot pin 532 is configured to be positioned inside the semi-circularly shaped recess 246 (see FIG. 10) of the second cutout portion 244B (see FIG. 10) and the semi-circularly shaped recess 316 (see FIG. 11) of the second support wall 314B (see FIG. 11) when the second support wall 314B is received inside the second cutout portion 244B. The second pivot pin 532 is configured to rotate inside the aligned recesses 246 (see FIG. 10) and 316 (see FIG. 11) with respect to the lid housing 170 (see FIG. 5).

The tethered portion 522 of the spout base 158 has first and second pivot pins 540 and 542 that extend outwardly from the first and second side portions 526 and 528, respectively. The first pivot pin 540 is configured to be inserted into the first through-hole 510 (see FIG. 15) of the first linkage 156A (see FIGS. 4, 6, 7, and 15) from the second side 502 (see FIG. 15). The second pivot pin 542 is configured to be inserted into the first through-hole 510 (see FIG. 15) of the second linkage 1566 (see FIGS. 4 and 8) from the first side 500 (see FIG. 15). The first and second linkages 156A and 156B (see FIG. 4) are configured to rotate about the first and second pivot pins 540 and 542, respectively.

First and second curved grooves 550 and 552 extend inwardly into the first and second side portions 526 and 528, respectively. The first and second curved grooves 550 and 552 are configured to receive the first and second pivot pins 480 and 482 (see FIG. 14), respectively, after they have passed through the second through-holes 512 (see FIG. 15) of the first and second linkages 156A and 1566 (see FIG. 4), respectively. Thus, the first and second pivot pins 480 and 482 (see FIG. 14) will not scrape against the spout base 158 as the spout base 158 rotates.

Referring to FIG. 16, the spout base 158 includes a keyway 560 configured to ensure the spout tip 160 (see FIGS. 2-4, 6-8, 18, and 19) is orientated properly with respect to the spout base 158. Referring to FIG. 8, the spout base 158 has an outer sidewall 562. In the embodiment illustrated, the outer sidewall 562 is opposite the keyway 560 (see FIG. 16). Referring to FIG. 2, when the spout 166 is in the closed position (see FIGS. 1, 6, and 8), an outwardly facing surface 563 of the outer sidewall 562 may be flush with the upwardly facing surface 204 of the upper housing portion 150.

Referring to FIG. 16, the outer sidewall 562 (see FIGS. 2 and 8) has a lower edge 564. In the embodiment illustrated, a recess 565 is formed on an inwardly facing surface 566 (see FIG. 17) along the lower edge 564. The inwardly facing surface 566 is opposite the outwardly facing surface 563 (see FIGS. 2 and 8). The lower edge 564 is configured to be received inside the recess 390 (see FIG. 11) when the spout 166 (see FIGS. 2 and 6-8) is in the open position (see FIGS. 2, 3, and 7). The inwardly facing surface 566 may abut the stop wall 392 (see FIG. 11) of the lower housing portion 152 (see FIGS. 2-7) when the spout 166 (see FIGS. 2 and 6-8) is in the open position (see FIGS. 2, 3, and 7).

In the embodiment illustrated, the first and second side portions 526 and 528 each have a curved lower edge 568. The curved lower edge 568 of the first side portion 526 may form a portion of a first circle having the first pivot pin 530 (see FIG. 17) at the first circle's center. The curved lower edge 568 of the second side portion 528 may form a portion of a second circle having the second pivot pin 532 at the second circle's center. The curved lower edges 568 are configured to allow the spout base 158 to rotate about the first and second pivot pins 530 and 532 with respect to the lid housing 170 (see FIG. 5)

Spout Tip

Figure 18:
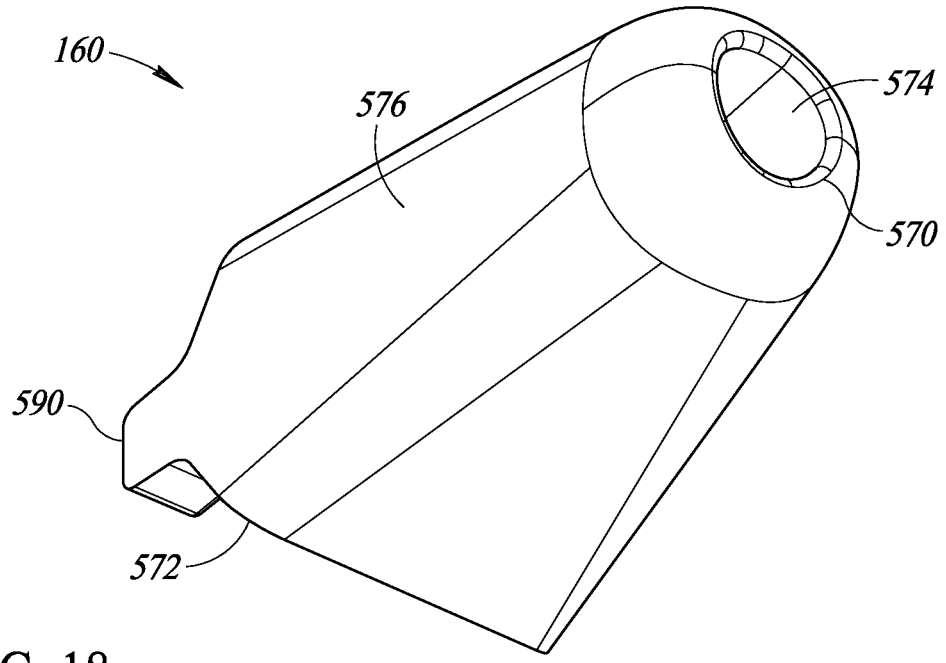
FIG. 18 is a perspective view of a side portion of the spout tip of the lid assembly of FIG. 1.

Referring to FIG. 18, the spout tip 160 has a free end portion 570 opposite a tethered end portion 572. In the embodiment illustrated, the spout tip 160 has a tapered shape that is narrower near the free end portion 570 than the tethered end portion 572.

Figure 19:
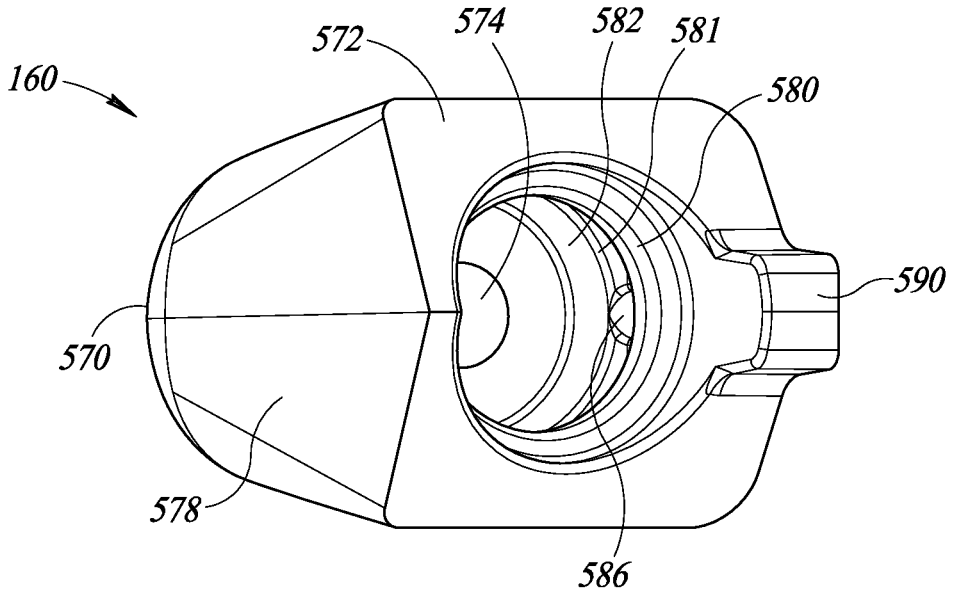
FIG. 19 is a perspective view of an underside of the spout tip of the lid assembly of FIG. 1.

Referring to FIG. 2, an outwardly facing surface 576 of the spout tip 160 may be flush with the upwardly facing surface 204 of the upper housing portion 150 when the spout 166 is in the closed position (see FIGS. 1, 6, and 8). Referring to FIG. 19, the spout tip 160 has an inwardly facing surface 578 opposite the outwardly facing surface 576 (see FIGS. 2 and 7).

An open-ended channel 574 extends between the free end portion 570 and the tethered end portion 572. The user drinks the liquid 116 (see FIG. 1) from the channel 574 at the free end portion 570. Thus, the opening of the open-ended channel 574 positioned at the free end portion 570 may be characterized as being a drinking aperture that is in fluid communication with the open-ended channel 574.

Referring to FIG. 19, in the tethered end portion 572, the spout tip 160 includes first, second, and third stop walls 580-582 that extend into the open-ended channel 574. A ridge 586 extends into the open-ended channel 574 between the first and second stop walls 580 and 581.

Referring to FIG. 8, the tethered end portion 572 is configured to be coupled to the free end portion 520 of the spout base 158. The tethered end portion 572 may have a friction fit with the free end portion 520 of the spout base 158 and may be configured to be removable therefrom. The locking portion 534 of the spout base 158 is configured to be received in between the first and second stop walls 580 and 581 (see FIG. 19), which help trap the free end portion 520 inside the open-ended channel 574. The notch 536 (see FIG. 16) is configured to receive the ridge 586 (see FIG. 19). Thus, the notch 536 (see FIG. 16) may function as a keyway with respect to the ridge 586 (see FIG. 19), which functions as a key. The tethered end portion 572 may have a key portion 590 configured to mate with the keyway 560 (see FIG. 16) of the spout base 158. Thus, the key portion 590 and the ridge 586 (see FIG. 19) help ensure the spout tip 160 is orientated properly with respect to the spout base 158.

The spout tip 160 may be constructed from a soft material that the user may find comfortable on the user's lips.

Connector Tube

Figure 21:
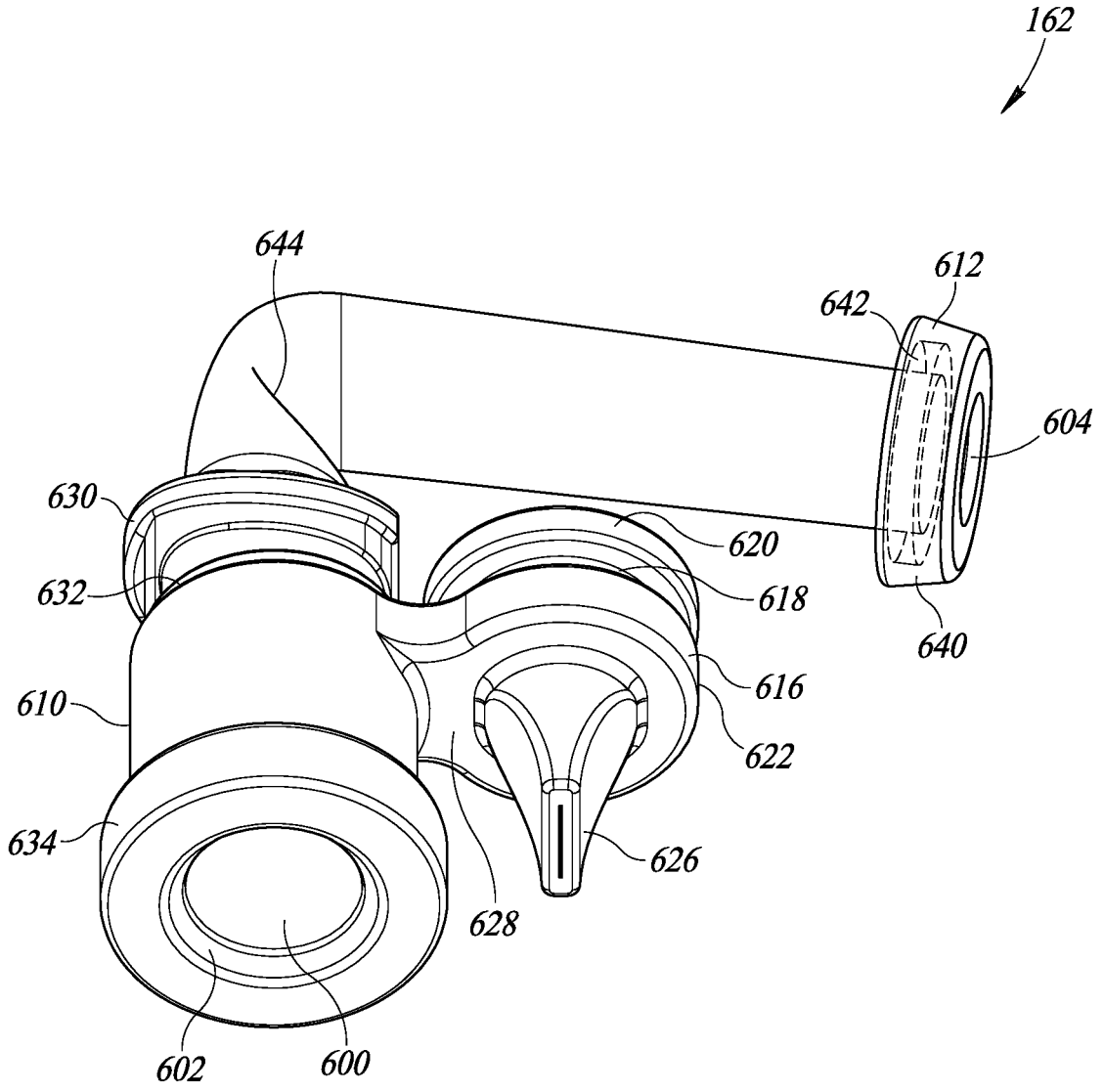
FIG. 21 is a perspective view of an underside of the connector tube of the lid assembly of FIG. 1 illustrated in a crimped configuration.

Referring to FIGS. 4 and 8, the connector tube 162 connects the straw 130 to the spout tip 160. Referring to FIG. 8, the connector tube 162 has a through-channel 600 that conducts the liquid 116 (see FIG. 1) received from the open end 132 of the straw 130 to the open-ended channel 574 of the spout tip 160. In other words, the through-channel 600 provides a liquid tight passageway from the open end 132 of the straw 130 to the free end portion 570 of the spout tip 160. Referring to FIG. 21, the through-channel 600 has a proximal opening 602 opposite a distal opening 604. Referring to FIG. 8, the proximal opening 602 (see FIG. 21) is configured to receive the open end 132 of the straw 130 and receives the liquid 116 (see FIG. 1) therefrom. Thus, the connector tube 162 is in fluid communication with the liquid 116 (see FIG. 1). The distal opening 604 outputs the liquid 116 (see FIG. 1) into the open-ended channel 574 of the spout tip 160. The user drinks the liquid 116 (see FIG. 1) from the free end portion 570 of the spout tip 160.

Referring to FIGS. 20 and 21, the connector tube 162 has a proximal portion 610 opposite a distal portion 612. The through-channel 600 extends through the connector tube 162 from the proximal portion 610 to the distal portion 612. The proximal opening 602 (see FIG. 21) is formed in the proximal portion 610 and the distal opening 604 is formed in the distal portion 612. The proximal portion 610 is configured to extend through the first through-hole 320 (see FIG. 11) of the lower housing portion 152 (see FIGS. 2-7). Referring to FIG. 8, the distal portion 612 is configured to extend through and line the open-ended channel 524 (see FIGS. 16 and 17) of the spout base 158.

Referring to FIGS. 20 and 21, the connector tube 162 includes a plug portion 616 connected to the proximal portion 610. Referring to FIG. 3, the plug portion 616 is configured to be received inside the second through-hole 322 (see FIG. 11) of the lower housing portion 152 and to extend beyond the second wall portion 328B. In the embodiment illustrated, the plug portion 616 includes an annular groove 618 (see FIGS. 20 and 21) configured to receive both a portion of the platform 300 that surrounds the second through-hole 322 (see FIG. 11) and the second wall portion 328B. Referring to FIGS. 20 and 21, the plug portion 616 has an upper stop portion 620 opposite a lower stop portion 622. Referring to FIG. 7, the upper stop portion 620 is configured to be received inside the annular recess 324 (see FIG. 11). Thus, when the upper stop portion 620 is seated inside the annular recess 324 (see FIG. 11), an outwardly facing surface 625 of the upper stop portion 620 may be flush with the upwardly facing surface 310 of the platform 300. Referring to FIG. 3, the lower stop portion 622 abuts a lower free edge of the second wall portion 328B. The lower stop portion 622 is connected to the proximal portion 610 by a connecting portion 628.

Optionally, referring to FIGS. 20 and 21, a vent projection 626 may extend downwardly from the lower stop portion 622 of the plug portion 616. The vent projection 626 functions as a one-way air valve or vent that allows air to pass therethrough and enter the vessel 112 (see FIGS. 1 and 2) as the liquid 116 (see FIG. 1) exits the vessel 112 through the through-channel 600. Thus, referring to FIG. 2, the vent projection 626 (see FIGS. 20 and 21) allows air to flow into the vessel 112 in exchange for the liquid 116 (see FIG. 1) when the user sips from the spout tip 160 of the spout 166. Referring to FIGS. 20 and 21, a through-hole or slit (not shown) is formed in (e.g., cut into) the vent projection 626. The slit (not shown) is configured to allow the air to flow therethrough into the vessel 112 (see FIGS. 1 and 2). However, the slit (not shown) does not allow the liquid 116 (see FIG. 1) to pass therethrough or leak out.

The proximal portion 610 has an upper stop portion 630, a middle stop portion 632, and a lower stop portion 634. The upper stop portion 630 abuts the upwardly facing surface 310 (see FIGS. 6, 7, and 11) of the platform 300 (see FIGS. 3, 6, 7, and 11). The upper stop portion 630 may be bent or contoured so that a portion of the upper stop portion 630 may rest upon the stop wall 392 (see FIG. 11). The middle stop portion 632 abuts the downwardly facing surface 312 (see FIG. 12) of the platform 300 (see FIGS. 3, 6, 7, and 11). Referring to FIG. 3, the lower stop portion 634 abuts a lower free edge of the first wall portion 328A.

Referring to FIG. 8, the distal portion 612 has a distal stop portion 640 configured to abut the locking portion 534 of the spout base 158. Referring to FIG. 21, the distal stop portion 640 includes an inwardly extending annular recess 642 configured to receive the distal portion 538 (see FIG. 16) of the spout base 158 (see FIGS. 2, 4, and 6-8). Referring to FIG. 19, when the locking portion 534 (see FIGS. 8 and 16) of the spout base 158 (see FIGS. 2, 4, and 6-8) is received in between the first and second stop walls 580 and 581 of the spout tip 160, the distal stop portion 640 (see FIGS. 8, 20, and 21) is positioned between the second and third stop walls 581 and 582. Referring to FIG. 8, the distal stop portion 640 may form a seal between the connector tube 162 and the spout tip 160 so that the liquid 116 (see FIG. 1) cannot leak out between the connector tube 162 and the spout tip 160. Thus, the liquid 116 (see FIG. 1) may flow from the through-channel 600 into the channel 574.

The distal portion 612 may be bent or crimped by the sidewall 529 (see FIGS. 16 and 17) of the spout base 158 when the spout 166 is in the closed position. When in the un-crimped configuration (see FIGS. 4 and 20), the connector tube 162 allows the liquid 116 (see FIG. 1) to flow from the straw 130 into the spout tip 160. On the other hand, when in the crimped configuration (see FIGS. 8 and 21), a crimp 644 (see FIG. 21) formed in the bent connector tube 162 blocks the flow of the liquid 116 (see FIG. 1) from the straw 130 into the spout tip 160. In other words, when the spout 166 is in the closed position (see FIGS. 1, 6, and 8), the connector tube 162 is bent or crimped, which shuts off the flow of the liquid (see FIG. 1).

Lid Seal

Referring to FIG. 1, the lid seal 164 (see FIGS. 3 and 4) helps ensure that the liquid 116 in the beverage container 100 will not leak from between the upper edge 124 of the vessel 112 and the lid assembly 110. As mentioned above, the lid seal 164 is configured to be positioned inside the lower housing portion 152 in the groove 340 (see FIG. 12) formed between the sidewall 302 (see FIGS. 11 and 12) and the annular inner stop wall 342 (see FIG. 12). When the inside threads 346 (see FIG. 12) are mated with the outside threads 128, the upper edge 124 of the vessel 112 presses against the lid seal 164 (see FIGS. 3 and 4), which prevents leaks. Referring to FIGS. 3 and 4, the lid seal 164 is illustrated as being an O-ring.

Operation

Referring to FIG. 6, to drink from the beverage container 100 (see FIG. 1) when the spout 166 is in the closed position, the user may push down on the button 154 to move the spout 166 to the open position (see FIGS. 2, 3, and 7). As mentioned above, referring to FIG. 5, when the button 154 (see FIGS. 2-4, 6-8, 13, and 14) is in the closed position (see FIGS. 1 and 6), the tabs 420 and 422 (see FIGS. 13 and 14) are positioned in the first recessed portions 266 of the first and second closed tracks 360 and 362 (see FIG. 2), respectively. Referring to FIG. 7, pushing down on the button 154 (in the direction identified by the arrow 514) causes the arms 424 and 426 (see FIGS. 13 and 14) to flex inwardly allowing the button 154 to slide downwardly within the first and second closed tracks 360 (see FIG. 5) and 362 (see FIG. 2) and traverse the first and second stops 262 and 264 (see FIG. 5). In other words, the button 154 overcomes a first mechanical snap formed between the tabs 420 and 422 (see FIGS. 13 and 14) the second stops 264 (see FIG. 5), which initiates rotation of the spout 166. Referring to FIG. 4, the button 154 is linked to the spout base 158 by the first and second linkages 156A and 156B, which translate the linear movement of the button 154 into angular rotation of the spout base 158. Referring to FIG. 7, as the button 154 continues to move downwardly, the button 154 overcomes a second mechanical snap formed between the tabs 420 and 422 (see FIGS. 13 and 14) the first stops 262 (see FIG. 5). Referring to FIG. 21, as the spout 166 (see FIGS. 2 and 6-8) rotates into the open position, the crimp 644 in the distal portion 612 of the connector tube 162 is removed to thereby open the through-channel 600 of the connector tube 162. As mentioned above, referring to FIG. 5, when the button 154 (see FIGS. 2-4, 6-8, 13, and 14) is in the open position (see FIGS. 2, 3, and 7), the tabs 420 and 422 (see FIGS. 13 and 14) are positioned in the third recessed portions 270 of the first and second closed tracks 360 and 362 (see FIG. 2), respectively. Referring to FIG. 2, at this point, the user may drink through the spout tip 160.

When the user has finished drinking, the user may push the button 154 upwardly to the closed position (see FIGS. 1 and 6) reversing the rotation of the spout 166 back into the closed position (see FIGS. 1, 6, and 8). The button 154 snaps into place because the tabs 420 and 422 (see FIGS. 13 and 14) traverse the first and second stops 262 and 264 (see FIG. 5) and are returned to the first recessed portion 266 (see FIG. 5) of the first and second closed tracks 360 (see FIG. 5) and 362 (see FIG. 2), respectively. Additionally, referring to FIG. 21, the crimp 644 is formed in the distal portion 612 of the connector tube 162, which blocks the flow of the liquid 116 (see FIG. 1) through the through-channel 600.

Alternatively, referring to FIGS. 6 and 7, instead of using the button 154 to rotate the spout 166 to the closed position, the user may push on the spout 166 (e.g., with the user's hand) and rotate the spout 166 toward the platform 300, which moves the button 154 upwardly within the first and second closed tracks 360 (see FIG. 5) and 362 (see FIG. 2) and into the closed position. In other words, the user may push the spout 166 down (e.g., with the user's finger(s)) directly instead of using the button 154 to rotate the spout 166.

Less force may be required to slide the button 154 than is required to open and/or close prior art lid assemblies that include a lever that must be pulled or pushed, with significant force, by the user's fingers. The button 154 operates using an intuitive or familiar up and down gesture or motion that may be performed by the user's thumb or finger. The button 154 may be operated by only one of the user's hands.

Referring to FIG. 1, the lid assembly 110 gives athletes and/or consumers quick and easy access to the liquid 116 (e.g., water). Referring to FIG. 2, the lid assembly 110 allows the user to deploy the spout 166, take a drink, and close the spout 166 very quickly and with one action of the button 154. As mentioned above, athletes prefer to hydrate quickly so they can get back to their workout routines. One hand can be used to both hold the beverage container 100 (see FIG. 1) and operate the button 154, which avoids distractions created by prior art lid assemblies.

Referring to FIG. 1, the first and second stops 262 and 264 (see FIG. 5) provide "haptics," or force-feedback physical cues that let the user know when the spout 166 is in the open or closed position without the user needing to looking at the lid assembly 110. Thus, the user may use the lid assembly 110 without ever looking at it to determine if the spout 166 is the open or closed positions or is in-between the open or closed positions.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lid assembly comprising:

a spout comprising a drinking aperture and a connector tube, the connector tube being configured to be in fluid communication with a liquid and to conduct the liquid toward the drinking aperture when the spout is in a spout open position, the connector tube being crimped when the spout is in a spout closed position, the connector tube preventing the liquid from flowing therethrough and toward the drinking aperture when the connector tube is crimped;

a button configured to slide linearly between a button open position and a button closed position; and at least one curved linkage coupling the button to the spout, the at least one curved linkage being configured to rotate the spout when the button slides linearly, the at least one curved linkage rotating the spout into the spout open position when the button is slid linearly into the button open position, the at least one curved linkage rotating the spout into the spout closed position when the button is slid linearly into the button closed position, the liquid being drinkable by a user from the drinking aperture when the spout is in the spout open position.

2. The lid assembly of claim 1, further comprising:

a housing configured to be coupled to a vessel storing both the liquid and a straw in fluid communication with the liquid, the connector tube of the spout being connected to the straw and configured to receive the liquid therefrom, the housing comprising first and second tracks, the button being slidable linearly within the first and second tracks with respect to the housing, the at least one curved linkage comprising first and second curved linkages, the button comprising first and second pivot pins, the first curved linkage comprising a first through-hole configured to receive the first pivot pin, the second curved linkage comprising a second through-hole configured to receive the second pivot pin, the first and second curved linkages being rotatable with respect to the first and second pivot pins.

3. The lid assembly of claim 2, wherein the first curved linkage comprises a third through-hole, the second curved linkage comprises a fourth through-hole, and the spout comprises:

third and fourth pivot pins configured to be received in the third and fourth through-holes, respectively; and fifth and sixth pivot pins rotatably mounted to the housing, the spout being configured to rotate with respect to the housing about the fifth and sixth pivot pins.

4. The lid assembly of claim 3, wherein the housing comprises:

an upper housing portion; and a lower housing portion attached to the upper housing portion, the fifth and sixth pivot pins being sandwiched in between the upper and lower housing portions.

5. The lid assembly of claim 4, wherein the lower housing portion comprises first and second through-holes, the connector tube comprises a proximal portion positioned within the first through-hole, and the connector tube comprises a plug portion positioned within the second through-hole, the plug portion being configured to prevent the liquid from flowing through the second through-hole.

6. The lid assembly of claim 1, further comprising:

a housing comprising first and second tracks, the button being slidable linearly within the first and second tracks with respect to the housing, the button being slidable downwardly from the button closed position to the button open position, the button being slidable upwardly from the button open position to the button closed position.

7. The lid assembly of claim 6, wherein the button comprises first and second tabs configured to be positioned in the first and second tracks, respectively, each of the first and second tracks comprises first and second recessed portions, the first and second tabs are positioned inside the first recessed portion of the first and second tracks, respectively, when the button is in the button closed position, and the first and second tabs are positioned inside the second recessed portion of the first and second tracks, respectively, when the button is in the button open position.

8. The lid assembly of claim 1, wherein the spout rotates at least 100 degrees when transitioning between the spout open position and the spout closed position.

9. A beverage container comprising:

a vessel configured to hold a liquid, the vessel comprising an opening;

a straw positioned inside the vessel, the straw being configured to conduct the liquid from the vessel; and a lid assembly configured to be coupled to the vessel to close the opening, the lid assembly comprising a housing, a spout, a button, a first curved linkage, and a second curved linkage, the housing comprising first and second tracks, the spout being configured to be coupled to the straw and to receive the liquid therefrom, the button comprising first and second pivot pins, the first curved linkage comprising a first through-hole configured to receive the first pivot pin, the second curved linkage comprising a second through-hole configured to receive the second pivot pin, the first and second curved linkages being rotatable with respect to the first and second pivot pins, the button being slidable linearly within the first and second tracks between a button open position and a button closed position, the button being coupled to the spout by the first and second curved linkages, the first and second curved linkages translating linear motion of the button into rotation by the spout, the first and second curved linkages being configured to rotate the spout between a spout open position and a spout closed position with respect to the housing.

10. The beverage container of claim 9, wherein the spout comprises a connector tube that is coupled to the straw and receives the liquid therefrom, the connector tube allows the liquid to flow therethrough when the spout is in the spout open position, the connector tube is crimped when the spout is in the spout closed position, and the crimped connector tube prevents the liquid from flowing therethrough.

11. The beverage container of claim 9, wherein the first curved linkage comprises a third through-hole, the second curved linkage comprises a fourth through-hole, and the spout comprises:

third and fourth pivot pins configured to be received in the third and fourth through-holes, respectively; and fifth and sixth pivot pins rotatably mounted to the housing, the spout being configured to rotate with respect to the housing about the fifth and sixth pivot pins.

12. The beverage container of claim 11, wherein the housing comprises:

an upper housing portion; and a lower housing portion attached to the upper housing portion, the fifth and sixth pivot pins being sandwiched in between the upper and lower housing portions.

13. The beverage container of claim 9, wherein the button is slid downwardly from the button closed position to the button open position, and the button is slid upwardly from the button open position to the button closed position.

14. The beverage container of claim 13, wherein the button comprises first and second tabs configured to be positioned in the first and second tracks, respectively, each of the first and second tracks comprise first and second recessed portions, the first and second tabs are positioned inside the first recessed portion of the first and second tracks, respectively, when the button is in the button closed position, and the first and second tabs are positioned inside the second recessed portion of the first and second tracks, respectively, when the button is in the button open position.

15. The beverage container of claim 9, wherein the spout rotates at least 100 degrees when transitioning between the spout open position and the spout closed position.

16. A lid assembly comprising:

a lid housing;

a spout base comprising a first through-channel, the spout base being rotatable with respect to the lid housing;

a flexible connector tube lining the first through-channel, the flexible connector tube comprising a second through-channel that extends through the spout base;

a spout tip coupled to the spout base, the spout tip being rotatable with the spout base as a unit, the spout tip comprising a third through-channel positioned to receive a liquid from the second through-channel, the spout tip comprising a free end portion with a drinking aperture in communication with the third through-channel;

a button configured to slide linearly with respect to the lid housing between a button open position and a button closed position; and a curved linkage coupling the button to the spout base, the curved linkage being configured to rotate the spout base when the button slides linearly, the curved linkage rotating the spout base into a spout open position when the button is slid linearly into the button open position, the curved linkage rotating the spout base into a spout closed position when the button is slid linearly into the button closed position, the flexible connector tube being crimped when the spout base is in the spout closed position, the flexible connector tube preventing the liquid from flowing through the second through-channel when the flexible connector tube is crimped, the flexible connector tube allowing the liquid to flow through the second through-channel and into the third through-channel when the spout base is in the spout open position, the liquid being drinkable by a user from the drinking aperture of the spout tip when the spout base is in the spout open position.

17. The lid assembly of claim 16, wherein the spout base rotates at least 100 degrees when transitioning between the spout open position and the spout closed position.

18. The lid assembly of claim 16, wherein the lid housing is configured to be coupled to a vessel storing both the liquid and a straw in fluid communication with the liquid, the flexible connector tube is connected to the straw and configured to receive the liquid therefrom, the lid housing comprises first and second tracks, the button is slidable linearly within the first and second tracks with respect to the lid housing, the curved linkage is a first curved linkage, the lid assembly comprises a second curved linkage, the button comprises first and second pivot pins, the first curved linkage comprises a first through-hole configured to receive the first pivot pin, the second curved linkage comprises a second through-hole configured to receive the second pivot pin, and the first and second curved linkages are rotatable with respect to the first and second pivot pins.

19. The lid assembly of claim 18, wherein the first curved linkage comprises a third through-hole, the second curved linkage comprises a fourth through-hole, and the spout base comprises:

third and fourth pivot pins configured to be received in the third and fourth through-holes; and fifth and sixth pivot pins rotatably mounted to the lid housing, the spout base being configured to rotate with respect to the lid housing about the fifth and sixth pivot pins.

20. The lid assembly of claim 19, wherein the lid housing comprises:

an upper housing portion; and a lower housing portion attached to the upper housing portion, the fifth and sixth pivot pins being sandwiched in between the upper and lower housing portions.

21. The lid assembly of claim 20, wherein the lower housing portion comprises first and second through-holes, the flexible connector tube comprises a proximal portion positioned within the first through-hole, the flexible connector tube comprises a plug portion positioned within the second through-hole, and the plug portion is configured to prevent the liquid from flowing through the second through-hole.

22. The lid assembly of claim 16, wherein the lid housing comprises first and second tracks, the button is slidable within the first and second tracks with respect to the lid housing, the button is slid downwardly from the button closed position to the button open position, and the button is slid upwardly from the button open position to the button closed position.

23. The lid assembly of claim 22, wherein the button comprises first and second tabs configured to be positioned in the first and second tracks, respectively, each of the first and second tracks comprises first and second recessed portions, the first and second tabs are positioned inside the first recessed portion of the first and second tracks, respectively, when the button is in the button closed position, and the first and second tabs are positioned inside the second recessed portion of the first and second tracks, respectively, when the button is in the button open position.

24. A lid assembly comprising:

a spout comprising a drinking aperture, the spout being configured to convey a liquid to the drinking aperture;

a button configured to slide linearly between a button open position and a button closed position; and at least one curved linkage coupling the button to the spout, the at least one curved linkage being configured to rotate the spout when the button slides linearly, the at least one curved linkage rotating the spout into a spout open position when the button is slid linearly into the button open position, the at least one curved linkage rotating the spout into a spout closed position when the button is slid linearly into the button closed position, the spout rotating at least 100 degrees when transitioning between the spout open position and the spout closed position, the liquid being drinkable by a user from the drinking aperture when the spout is in the spout open position.

25. The lid assembly of claim 24, further comprising:

a housing configured to be coupled to a vessel storing both the liquid and a straw in fluid communication with the liquid, the spout comprising a connector tube configured to be in fluid communication with the liquid, the connector tube being configured to conduct the liquid toward the drinking aperture when the spout is in the spout open position, the connector tube being crimped when the spout is in the spout closed position, the connector tube preventing the liquid from flowing therethrough and toward the drinking aperture when the connector tube is crimped, the connector tube being connected to the straw and configured to receive the liquid therefrom, the housing comprising first and second tracks, the button being slidable linearly within the first and second tracks with respect to the housing, the at least one curved linkage comprising first and second curved linkages, the button comprising first and second pivot pins, the first curved linkage comprising a first through-hole configured to receive the first pivot pin, the second curved linkage comprising a second through-hole configured to receive the second pivot pin, the first and second curved linkages being rotatable with respect to the first and second pivot pins.

26. The lid assembly of claim 25, wherein the first curved linkage comprises a third through-hole, the second curved linkage comprises a fourth through-hole, and the spout comprises:

third and fourth pivot pins configured to be received in the third and fourth through-holes, respectively; and fifth and sixth pivot pins rotatably mounted to the housing, the spout being configured to rotate with respect to the housing about the fifth and sixth pivot pins.

27. The lid assembly of claim 26, wherein the housing comprises:

an upper housing portion; and a lower housing portion attached to the upper housing portion, the fifth and sixth pivot pins being sandwiched in between the upper and lower housing portions.

28. The lid assembly of claim 27, wherein the lower housing portion comprises first and second through-holes, the connector tube comprises a proximal portion positioned within the first through-hole, and the connector tube comprises a plug portion positioned within the second through-hole, the plug portion being configured to prevent the liquid from flowing through the second through-hole.

29. The lid assembly of claim 24, further comprising:

a housing comprising first and second tracks, the button being slidable linearly within the first and second tracks with respect to the housing, the button being slidable downwardly from the button closed position to the button open position, the button being slidable upwardly from the button open position to the button closed position.

30. The lid assembly of claim 29, wherein the button comprises first and second tabs configured to be positioned in the first and second tracks, respectively, each of the first and second tracks comprises first and second recessed portions, the first and second tabs are positioned inside the first recessed portion of the first and second tracks, respectively, when the button is in the button closed position, and the first and second tabs are positioned inside the second recessed portion of the first and second tracks, respectively, when the button is in the button open position.

31. A beverage container comprising:

a vessel configured to hold a liquid, the vessel comprising an opening;

a straw positioned inside the vessel, the straw being configured to conduct the liquid from the vessel; and a lid assembly configured to be coupled to the vessel to close the opening, the lid assembly comprising a housing, a spout, a button, and a linkage, the housing comprising first and second tracks, each of the first and second tracks comprising first and second recessed portions, the spout being configured to be coupled to the straw and to receive the liquid therefrom, the button comprising first and second tabs configured to be positioned in the first and second tracks, respectively, the button being slidable linearly within the first and second tracks between a button open position and a button closed position, the button being slid downwardly from the button closed position to the button open position, the first and second tabs being positioned inside the second recessed portion of the first and second tracks, respectively, when the button is in the button open position, the button being slid upwardly from the button open position to the button closed position, the first and second tabs being positioned inside the first recessed portion of the first and second tracks, respectively, when the button is in the button closed position, the button being coupled to the spout by the linkage, the linkage translating linear motion of the button into rotation by the spout, the linkage being configured to rotate the spout between a spout open position and a spout closed position with respect to the housing.

32. The beverage container of claim 31, wherein the spout comprises a connector tube that is coupled to the straw and receives the liquid therefrom, the connector tube allows the liquid to flow therethrough when the spout is in the spout open position, the connector tube is crimped when the spout is in the spout closed position, and the crimped connector tube prevents the liquid from flowing therethrough.

33. The beverage container of claim 31, wherein the linkage is a first curved linkage, the beverage container comprises a second curved linkage, the button comprises first and second pivot pins, the first curved linkage comprises a first through-hole configured to receive the first pivot pin, the second curved linkage comprises a second through-hole configured to receive the second pivot pin, the first and second curved linkages are rotatable with respect to the first and second pivot pins, the first curved linkage comprises a third through-hole, the second curved linkage comprises a fourth through-hole, the spout comprises third and fourth pivot pins configured to be received in the third and fourth through-holes, respectively; and the spout comprises fifth and sixth pivot pins rotatably mounted to the housing, the spout being configured to rotate with respect to the housing about the fifth and sixth pivot pins.

34. The beverage container of claim 33, wherein the housing comprises:

an upper housing portion; and a lower housing portion attached to the upper housing portion, the fifth and sixth pivot pins being sandwiched in between the upper and lower housing portions.

35. The beverage container of claim 31, wherein the spout rotates at least 100 degrees when transitioning between the spout open position and the spout closed position.

* * * * *